US005804362A

United States Patent [19]

Kuno et al.

[11] Patent Number: 5,804,362

[45] Date of Patent: Sep. 8, 1998

[54] SILVER HALIDE PHOTOGRAPHIC MATERIAL

[75] Inventors: Koichi Kuno; Yuji Mihara, both of Kanagawa, Japan

[73] Assignee: Fuji Photo Film Co., Ltd., Kanagawa, Japan

[21] Appl. No.: 822,956

[22] Filed: Mar. 21, 1997

Related U.S. Application Data

[63] Continuation of Ser. No. 474,973, Jun. 7, 1995, abandoned, which is a continuation of Ser. No. 5,168, Jan. 15, 1993, abandoned, which is a continuation of Ser. No. 812,854, Dec. 23, 1991, abandoned, which is a continuation of Ser. No. 504,202, Apr. 4, 1990, abandoned.

[30] Foreign Application Priority Data

Apr. 6, 1989 [JP] Japan ..... 1-87369

[51] Int. Cl.[6] ..... G03C 1/035

[52] U.S. Cl. ..... 430/567; 430/573; 430/576; 430/584; 430/611; 430/944

[58] Field of Search ..... 430/567, 573, 430/576, 584, 611, 944

[56] References Cited

U.S. PATENT DOCUMENTS

| | | | |
|---|---|---|---|
| 4,198,240 | 4/1980 | Mikawa | 430/570 |
| 4,276,374 | 6/1981 | Mifune et al. | 430/611 |
| 4,536,473 | 8/1985 | Mihara | 430/575 |
| 4,677,053 | 6/1987 | Mihara et al. | 430/576 |
| 4,910,129 | 3/1990 | Takahashi et al. | 430/573 |
| 4,960,689 | 10/1990 | Nishikawa et al. | 430/603 |
| 5,009,992 | 4/1991 | Friedrich et al. | 430/573 |

*Primary Examiner*—Janet C. Baxter

*Attorney, Agent, or Firm*—Sughrue, Mion, Zinn, Macpeak & Seas, PLLC

[57] ABSTRACT

A silver halide photographic material is disclosed, comprising a support having thereon at least one silver halide photographic emulsion layer of a silver halide emulsion, wherein the emulsion layer comprises monodisperse cubic silver halide grains which contain at least one metal atom of group VIII in the Periodic Table, and the silver halide emulsion is spectrally sensitized so as to have a sensitization maximum at a wavelength of 750 nm or more and further contains at least one of compounds represented by the following formulae (I-a), (I-b) and (I-c):

$$Z-SO_2.S-M \quad \text{(I-a)}$$

(I-b)

(I-c)

wherein Z represents an alkyl group containing 1 to 18 carbon atoms, an aryl group containing 6 to 18 carbon atoms, or a heterocyclic group; Y represents atoms necessary to complete an aromatic ring containing 6 to 18 carbon atoms, or a hetero ring; M represents a metal atom or an organic cation; and n represents an integer of from 2 to 10.

7 Claims, No Drawings

SILVER HALIDE PHOTOGRAPHIC MATERIAL

This is a Continuation of application Ser. No. 08/474,973 filed on Jun. 7, 1995, now abandoned; which in turn is a Continuation of application Ser. No. 08/005,168 filed on Jan. 15, 1993, now abandoned; which in turn is a Continuation of application Ser. No. 07/812,854 filed on Dec. 23, 1991, now abandoned; which in turn is a Continuation of application Ser. No. 07/504,202, filed on Apr. 4, 1990, now abandoned.

FIELD OF THE INVENTION

The present invention relates to a silver halide photographic material which is spectrally sensitized in the infrared region and, more particularly, to a high contrast silver halide photographic material which is spectrally sensitized in the infrared region.

BACKGROUND OF THE INVENTION

One known image forming method utilizes a so-called scanning system as an exposure method for photo-sensitive materials, in which an original is scanned, and on the basis of the image signals obtained by this scanning, the exposure of silver halide photographic materials is carried out to form negative or positive images corresponding to the original image.

Many recording apparatuses have been designed so as to embody the image forming method based on the scanning system. In such scanning recording apparatuses, a glow lamp, a xenon lamp, a mercury lamp, a tungsten lamp, a light emission diode and the like have so far been used as a light source for recording. However, all of these light sources are disadvantageous from the practical point of view because they have weak power and a short life. As scanners to overcome the above-described problems, therefore, those which use coherent laser light, such as an Ne—He laser, an argon laser, an He—Cd laser, etc., as a light source have been designed, too. Although these light sources have high power, recording apparatuses equipped therewith have disadvantages in that they are large in size and high in price, require a modulator, and are inferior in handling facility because visible light is used as a light source, thereby limiting the safelight usable for light-sensitive materials.

In contrast to the above-cited lasers, semi-conductor lasers are advantageous because they are small in size and low in price, are modulated with ease, have a lifespan longer than the foregoing lasers, and are superior in handling facility because they emit infrared rays to make it feasible to use a bright safelight when light-sensitive materials having their color sensitivities in the infrared region are used.

However, semiconductor lasers have a broad energy distribution when used without any wave shaping. Therefore, it is difficult to provide halftone dot and line images of good quality. In the production of a halftone or line image of good quality by the use of exposure means with a broad energy distribution, special developers called lith developers have so far been employed. A lith developer contains only hydroquinone as a developing agent and has a free sulfite ion concentration controlled to an extremely low value (generally 0.1 mol/liter or less) through the use of sulfites as a preservative in the form of the formaldehyde adduct so that infectious development is not inhibited. Consequently, the lith developer has a serious disadvantage in that it is exceptionally subject to air oxidation, or it cannot withstand preservation prolonged beyond 3 days.

Accordingly, in the case where great importance is attached to the stability during the processing, general black-and-white developers are employed. Although the developers used in this case have much higher stability, they suffer from the disadvantage that halftone dot quality and the like achieved by development with these developers are inferior to those achieved with lith developers.

SUMMARY OF THE INVENTION

Therefore, an object of the present invention is to provide a silver halide photographic material which has such photographic properties in that high contrast can be achieved even by development using a stable, general type of black-and-white developer, and sensitivity to infrared rays is sufficiently high.

The above-described object of the present invention is attained with a silver halide photographic material comprising a support having thereon at least one silver halide photographic emulsion layer of a silver halide emulsion, wherein the emulsion layer comprises monodisperse cubic silver halide grains which contain at least one metal atom of group VIII in the Periodic Table, and the silver halide emulsion is spectrally sensitized so as to have the sensitization maximum at a wavelength of 750 nm or more and further contains at least one of compounds represented by formulae (I-a), (I-b) and (I-c):

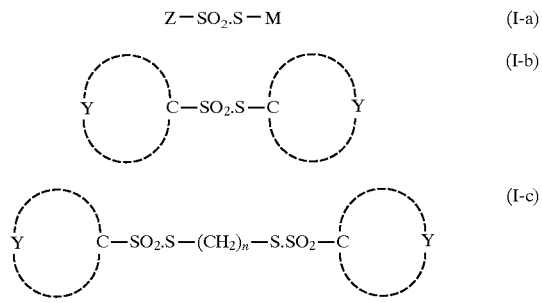

$$Z-SO_2.S-M \quad \text{(I-a)}$$

(I-b)

(I-c)

wherein Z represents an alkyl group containing 1 to 18 carbon atoms, an aryl group containing 6 to 18 carbon atoms, or a heterocyclic group; Y represents atoms necessary to complete an aromatic ring containing 6 to 18 carbon atoms, or a hetero ring; M represents a metal atom or an organic cation; and n represents an integer of from 2 to 10.

DETAILED DESCRIPTION OF THE INVENTION

The silver halide to be used in the present invention may be any of silver chloride, silver chlorobromide, silver iodobromide, silver iodochlorobromide and so on, but it is preferably one which has an iodide content of 10 mol % or less, particularly from 0.05 to 5 mol %.

An average grain size of the silver halide to be used in the present invention is preferably within the scope of fine grains (e.g., 0.7 $\mu$m or less), particularly 0.5 $\mu$m or less.

The silver halide grains in the present invention are cubic grains constructed by (100) faces in a substantial sense. The expression "grains constructed by (100) faces in a substantial sense" as used herein means that at least 50% (by number), preferably at least 80%, and particularly preferably at least 95%, of the grains contained in a silver halide emulsion have a cubic form, and/or the case that at least 60% of the surface area of each grain comprises (100) faces.

The size distribution of the silver halide grains to be used in the present invention is preferably monodisperse. The terminology "monodisperse emulsion" as used herein refers to a disperse system which has a variation coefficient (defined below) of 40% or less, especially 20% or less, in size distribution of emulsion grains.

The variation coefficient used herein is defined as follows:

$$\text{Variation coefficient (\%)} = \frac{\text{Standard deviation of grain sizes}}{\text{Average grain size}} \times 100$$

The photographic emulsions to be used in the present invention can be prepared using methods as described in P. Glafkides, *Chemie et Physique Photographique*, Paul Montel, Paris (1967), G. F. Duffin, *Photographic Emulsion Chemistry*, The Focal Press (1966), V. L. Zelikman et al., *Making and Coating Photographic Emulsion*, The Focal Press (1964), and so on. Namely, an acid process, a neutral process, an ammonia process and other conventional processes may be employed, and suitable methods for reacting a water-soluble silver salt with a water-soluble halide include a single jet method, a double jet method and a combination thereof.

Also, a method in which silver halide grains are produced in the presence of excess silver ions (the so-called reversal mixing method) may be employed. On the other hand, the so-called controlled double jet method in which the pAg of the liquid phase in which silver halide grains are to be precipitated is maintained constant may be also employed.

According to this method, a silver halide emulsion which contains grains having a regular crystal form and is almost uniform in grain size can be obtained.

For the purpose of obtaining a uniform grain size, it is also advisable to employ the methods as disclosed in British Patent 1,535,016, JP-B-48-36890 and JP-B-52-16364 (the term "JP-B" as used herein refers to an "examined Japanese patent publication"), in which addition speeds of silver nitrate and alkali halides are altered depending on the speed of grain growth, or the methods as disclosed in U.S. Pat. No. 4,242,445 and JP-A-55-158124 (the term "JP-A" as used herein refers to a "published unexamined Japanese patent application"), in which grain growth is sped up using a method of changing concentrations of aqueous solutions within the limits of the critical saturation degree.

The silver halide grains may be those having a so-called core/shell structure in which the interior and the surface of the grains differ in halide composition. In the case of silver iodobromide, in particular, it is to be desired that an iodide content in the core should be higher than that in the shell by generally at least 0.5 mol %, preferably at least 2 mol %.

In preparing the silver halide emulsions to be used in the present invention, it is desirable to use a silver halide solvent at the stage of grain formation.

Examples of silver halide solvents which can be used in the present invention include (a) organic thioethers as disclosed, e.g., in U.S. Pat. No. 3,271,157, 3,531,289 and 3,574,628, (b) thiourea derivatives as disclosed in JP-A-53-82408 and JP-A-55-77737, (c) silver halide solvents containing an oxygen atom or a carbonyl group as disclosed in JP-A-53-144319, (d) imidazoles as disclosed in JP-A-54-100717, (e) sulfites, (f) thiocyanates, and (g) thiones. Among these compounds, thioethers are preferred. Specific examples of such thioethers include

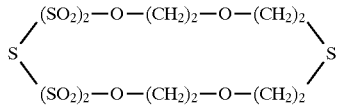

$$\begin{array}{l} CH_2-NHCOCH_2CH_2COH \\ | \\ CH_2-S-CH_2CH_2SC_2H_5 \end{array}$$

$$HO-(CH_2)_2-S-(CH_2)_2-S-(CH_2)_2-OH$$

Group VIII metals in the Periodic Table to be used in the present invention include iron, cobalt, nickel, ruthenium, rhodium, palladium, osmium, iridium and platinum. Examples of compounds containing these metals which can be preferably used in the present invention include ferrous sulfate ($FeSO_4.5H_2O$), ferric chloride ($FeCl_3$), potassium hexacyanoferrate(II) ($K_4Fe(CN)_6.3H_2O$), potassium hexacyanoferrate(III) ($K_3Fe(CN)_6$), cobalt(II) chloride ($CoCl_2$), cobalt(II) nitrate ($Co(NO_3)_2.6H_2O$), potassium hexacyanocobaltate(III) ($K_3Co(CN)_6$), nickel(II) chloride ($NiCl_2.6H_2O$), nickel(II) nitrate ($Ni(NO_3)_2.6H_2O$), ruthenium(III) chloride ($RuCl_3$), potassium hexachororuthenate(IV) ($K_2RuCl_6$), rhodium(III) chloride ($RhCl_3.4H_2O$), ammonium hexachororhodanate(III) ($(NH_4)_3RhCl_6$), palladium(II) chloride ($PdCl_2$), palladium (II) nitrate ($Pd(NO_3)_2$), palladium(II) bromide ($PdBr_2$), potassium hexachloropalladate(IV) ($K_2PdCl_6$), potassium tetrathiocyanatopalladate(II) ($K_2Pd(CNS)_4$), osmium(II) chloride ($OsCl_2$), iridium(III) chloride ($IrCl_3$), iridium(IV) chloride ($IrCl_4$), iridium(III) bromide ($IrBr_3.4H_2O$), iridium (IV) bromide ($IrBr_4$), potassium hexachloroiridate(III) ($K_3IrCl_6$), potassium hexachloroiridate(IV) ($K_2IrCl_6$), ammonium hexachloroplatinate(IV) ($(NH_4)_2PtCl_6$), potassium hexachloroplatinate(IV) ($K_2PtCl_6$), ammonium hexabromoplatinate(IV) ($(NH_4)_2PtBr_6$), and so on. These group VIII metal compounds in the Periodic Table can be used alone or as a combination of two or more thereof, and the amount is a range of from $1\times10^{-9}$ to $1\times10^{-3}$ mol per mol of silver halide. In particular, the combined use of two or three compounds chosen from among iridium salts, rhodium salts and iron salts is of great advantage. Such compounds can be added at any stage during the preparation of a silver halide emulsion or before the emulsion coating, if desired. More specifically, they may be added at either the nucleation or grain growth stage in the above-described methods of forming silver halide grains. On the other hand, they may be added during the chemical ripening of a silver halide emulsion. In particular, it is preferred that such compounds should be incorporated in silver halide grains.

The other compound to be used in the present invention, which is represented by formula (I-a), (I-b) or (I-c), is illustrated in detail below.

$$Z-SO_2.S-M \quad \text{(I-a)}$$

(I-b)

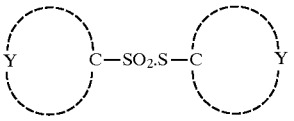

(I-c)

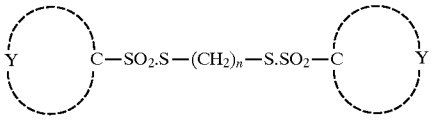

In the foregoing formulae, Z represents an alkyl group containing 1 to 18 carbon atoms, an aryl group containing 6 to 18 carbon atoms, or a heterocyclic group; Y represents atoms necessary to complete an aromatic ring containing 6 to 18 carbon atoms, or a hetero ring; M represents a metal atom or an organic cation; and n represents an integer of from 2 to 10.

The alkyl group, the aryl group, and the heterocyclic group represented by Z, and the aromatic ring and the hetero ring represented by Y in formula (I-a), (I-b) or (I-c) may be substituted.

Substituent groups suitable for such groups and rings include lower alkyl groups such as methyl, ethyl, etc., aryl groups such as phenyl, etc., alkoxyl groups containing 1 to 8 carbon atoms, halogen atoms such as chlorine, etc., a nitro group, an amino group, a carboxyl group, and so on.

Examples of a hetero ring represented by Z and Y each include thiazole, benzothiazole, imidazole, benzimidazole, oxazole and like rings.

Examples of a metal atom represented by M include alkali metal atoms such as sodium and potassium, and those of an organic cation represented by M include an ammonium ion and a guanidino group.

Specific examples of the compounds represented by formulae (I-a), (I-b) and (I-c) are illustrated below, although the present invention should not be construed as being limited to these examples.

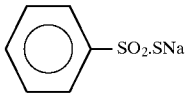

(I-1)

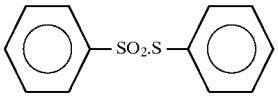

(I-2)

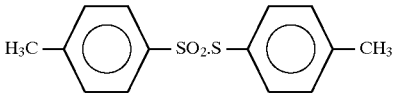

(I-3)

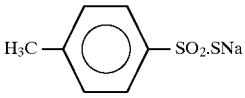

(I-4)

$H_3C.SO_2.SNa$ (I-5)

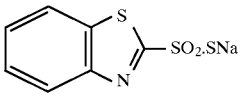

(I-6)

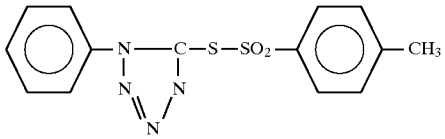

(I-7)

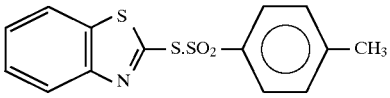

(I-8)

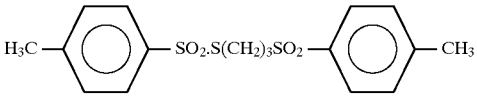

(I-9)

-continued

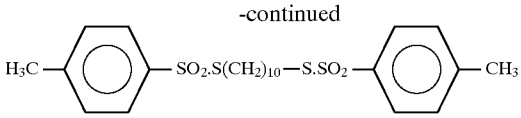

(I-10)

1-Cystine-disulfoxide I-11)

Compounds included in those represented by formulae (I-a) such as (I-1), (I-4), (I-5) and (I-6), (I-b) such as (I-2), (I-3), (I-7) and (I-8), and (I-c) such as (I-9), (I-10) and (I-11) can be synthesized using well known methods.

For instance, they can be produced by making their corresponding sulfonylfluorides react with sodium sulfide, or making their corresponding sodium sulfinates react with sulfur. Also, these compounds can be obtained with ease as commercial products.

The compound represented by formula (I-a), (I-b) or (I-c) in the present invention is preferably present in an amount of from $1\times10^{-5}$ to 1 g, particularly from $1\times10^{-4}$ to $1\times10^{-2}$ g, per mol of silver halide.

The compounds described above may be added at any stage of the emulsion grain formation or the chemical ripening time. In particular, it is desirable to add them before the grain formation or just before the beginning of chemical ripening.

The silver halide emulsions of the present invention are preferably subjected to gold sensitization and sulfur sensitization.

Gold sensitizers which can be used in the present invention include various gold salts such as potassium chloroaurate, potassium aurothiocyanate, auric trichloride, etc. Specific examples of gold sensitizers are disclosed in U.S. Pat. Nos. 2,399,083 and 2,642,361.

Sulfur sensitizers which can be used in the present invention include sulfur compounds contained in gelatin, and other various kinds of sulfur compounds such as thiosulfates, thioureas, thiazoles, rhodanines, etc. Specific examples include those disclosed in U.S. Pat. Nos. 1,574,944, 2,278,947, 2,410,689, 2,728,668, 3,501,313 and 3,656,955. Preferred sulfur compounds are thiosulfates and thiourea compounds.

A sulfur sensitizer and a gold sensitizer are present in a total amount of preferably from $1\times10^{-2}$ to $1\times10^{-7}$ mol, more preferably from $1\times10^{-3}$ to $1\times10^{-5}$ mol, per mol of silver.

A ratio of the sulfur sensitizer to the gold sensitizer ranges generally from 1/3 to 3/1, preferably from 1/2 to 2/1, by mol.

A reduction sensitization process can be used in the present invention also.

Reduction sensitizers which can be used include stannous salts, amines, formamidinesulfinic acid, silane compounds and so on.

The silver halide emulsion of the present invention is sensitized in the infrared region so as to have its sensitization maximum at a wavelength of 750 nm or more. Although sensitizing dyes for the infrared sensitization may be any of conventional ones, a dye represented by formula (IIIa) or (IIIb) is particularly preferred from the standpoints of sensitizability and stability.

The infrared sensitizing dyes represented by formulae (IIIa) and (IIIb) are illustrated in detail below.

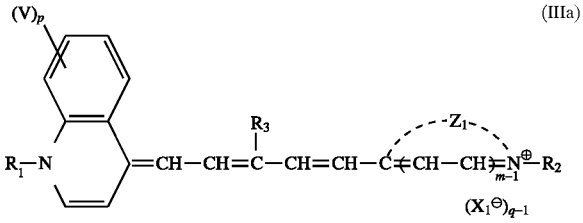

(IIIa)

In the foregoing formula (IIIa), $R_1$ and $R_2$ may be the same or different, each being an alkyl group; $R_3$ represents a hydrogen atom, a lower alkyl group, a lower alkoxy group, a phenyl group, a benzyl group, or a phenethyl group; V represents a hydrogen atom, a lower alkyl group, an alkoxy group, a halogen atom, or a substituted alkyl group; $Z_1$ represents nonmetal atoms necessary to complete a 5- or 6-membered nitrogen-containing hetero ring; $X_1$ represents an acid anion; and m, p and q each represents 1 or 2, provided that q is 1 when the dye forms an inner salt.

More specifically, $R_1$ and $R_2$ in formula (IIIa) may be the same or different, and each represents an alkyl group (including a substituted alkyl group), preferably containing 1 to 8 carbon atoms, with specific examples including methyl, ethyl, propyl, butyl, pentyl, heptyl and octyl groups.

Examples of the alkyl group for $R_1$ and $R_2$ include alkyl groups (preferably containing not more than 6 carbon atoms in an alkyl moiety) substituted by a carboxyl group, a sulfo group, a cyano group, a halogen atom (e.g., fluorine, chlorine, bromine), a hydroxyl group, an alkoxycarbonyl group (preferably containing not more than 8 carbon atoms, e.g., methoxycarbonyl, ethoxycarbonyl, benzyloxycarbonyl), an alkoxy group (preferably containing not more than 7 carbon atoms, e.g., methoxy, ethoxy, propoxy, butoxy, benzyloxy), an aryloxy group (e.g., phenoxy, p-tolyloxy), an acyloxy group (preferably containing not more than 3 carbon atoms, e.g., acetyloxy, propionyloxy), an acyl group (preferably containing not more than 8 carbon atoms, e.g., acetyl, propionyl, benzoyl, mesyl), a carbamoyl group (e.g., carbamoyl, N,N-dimethylcarbamoyl, morpholinocarbamoyl, piperidinocarbamoyl), a sulfamoyl group (e.g., sulfamoyl, N,N-dimethylsulfamoyl, morpholinosulfonyl), an aryl group (e.g., phenyl, p-hydroxyphenyl, p-carboxyphenyl, p-sulfophenyl, α-naphthyl), and so on. Also, the alkyl groups may have two or more of the above-cited substituent groups in combination.

$R_3$ represents a hydrogen atom, a lower alkyl group (preferably containing 1 to 4 carbon atoms, e.g., methyl, ethyl, propyl, butyl), a lower alkoxy group (preferably containing 1 to 4 carbon atoms, e.g., methoxy, ethoxy, propoxy, butoxy), a phenyl group, a benzyl group or a phenethyl group. In particular, a lower alkyl group and benzyl group are preferred as $R_3$.

V represents a hydrogen atom, a lower alkyl group (preferably containing 1 to 4 carbon atoms, e.g., methyl, ethyl, propyl), an alkoxy group (preferably containing 1 to 4 carbon atoms, e.g., methoxy, ethoxy, butoxy), a halogen atom (e.g., fluorine, chlorine), or a substituted alkyl group (preferably containing 1 to 4 carbon atoms, e.g., trifluoromethyl, carboxymethyl).

Z1 represents nonmetal atoms necessary to complete a 5- or 6-membered nitrogen-containing hetero ring, with specific examples including thiazole nuclei (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), selenazole nuclei (e.g., benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole), oxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole), quinoline nuclei (e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline), 3,3-dialkylindolenine nuclei (e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine), imidazole nuclei (e.g., 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole), and pyridine nuclei (e.g., pyridine, 5-methyl-2-pyridine, 3-methyl-4-pyridine). Among these nuclei, thiazole and oxazole nuclei are employed advantageously. In particular, benzothiazole, naphthothiazole, naphthoxazole and benzoxazole nuclei are preferred.

As noted above, m, p and q each represents 1 or 2, provided that q is 1 when the dye forms an inner salt.

$X_1$ represents an acid anion (e.g., chloride, bromide, iodide, tetrafluoroborate, hexafluorophosphate, methylsulfate, ethylsulfate, benzenesulfonate, 4-methylbenzenesulfonate, 4-chlorobenzenesulfonate, 4-nitrobenzenesulfonate, trifluoromethanesulfonate, perchlorate).

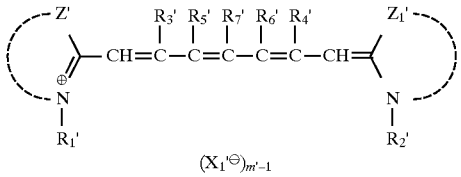

(IIIb)

In the foregoing formula (IIIb), $R_1'$ and $R_2'$ may be the same or different, and each represents an alkyl group; $R_3'$ and $R_4'$ each represents a hydrogen atom, a lower alkyl group, a lower alkoxy group, a phenyl group, a benzyl group or a phenethyl group; $R_5'$ and $R_6'$ each represents a hydrogen atom, or they may be linked with each other to form a divalent alkylene group; $R_7'$ represents a hydrogen atom, a lower alkyl group, a lower alkoxy group, a phenyl group, a benzyl group or

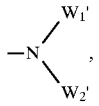

wherein $W_1'$ and $W_2'$ each may represent an alkyl group or an aryl group, or they may be linked with each other to complete a 5- or 6-membered nitrogen-containing hetero ring, or $R_3'$ and $R_7'$ or $R_4'$ and $R_7'$ may be linked to form a divalent alkylene group; Z' and $Z_1'$ each represents nonmetal atoms necessary to complete a 5- or 6-membered nitrogen-containing hetero ring; $X_1'$ represents an acid anion; and m' represents 1 or 2, provided that m' is 1 when the dye forms an inner salt.

The alkyl groups represented by $R_1'$ and $R_2'$ in formula (IIIb) include substituted alkyl groups. Specific examples thereof are the same as given in the description of $R_1$ and $R_2$ in formula (IIIa).

Specific examples of $R_3'$ and $R_4'$ in formula (IIIb) are the same as given in the description of $R_3$ in formula (IIIa).

$R_5'$ and $R_6'$ each represents a hydrogen atom, or they may be linked with each other to form a divalent alkylene group (e.g., ethylene or trimethylene). Such an alkylene group may be substituted by one, two or more of a proper group, e.g., an alkyl group (preferably containing 1 to 4 carbon atoms, e.g., methyl, ethyl, propyl, isopropyl, butyl), a halogen atom (e.g., chlorine, bromine), an alkoxy group (preferably containing 1 to 4 carbon atoms, e.g., methoxy, ethoxy, propoxy, isopropoxy, butoxy), and so on.

$R_7'$ represents a hydrogen atom, a lower alkyl group (preferably containing 1 to 4 carbon atoms, e.g., methyl, ethyl, propyl), a lower alkoxy group (preferably containing 1 to 4 carbon atoms, e.g., methoxy, ethoxy, propoxy, butoxy), a phenyl group, a benzyl group, or

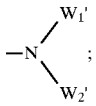

wherein $W_1'$ and $W_2'$ each represents an alkyl group (including substituted alkyl groups which preferably have an alkyl moiety containing 1 to 18, especially 1 to 4, carbon atoms, e.g., methyl, ethyl, propyl, butyl, benzyl, phenylethyl) or an aryl group (including substituted phenyl groups, e.g., phenyl, naphthyl, tolyl, p-chlorophenyl), and they may be linked with each other to complete a 5- or 6-membered nitrogen-containing hetero ring. Moreover, $R_3'$ and $R_7'$ or $R_4'$ and $R_7'$ may be linked to form a divalent alkylene group (having the same meaning as the foregoing divalent alkylene group formed by the combination of $R_5'$ with $R_6'$).

Specific examples of a 5- or 6-membered nitrogen-containing hetero ring completed by Z' and $Z_1'$, respectively, are the same as given in the description of $Z_1$ of formula (IIIa).

Specific examples of an acid anion represented by $X_1'$ are the same as given in the description of $X_1$ of formula (IIIa).

m' represents 1 or 2, provided that m' is 1 when the dye forms an inner salt.

Specific examples of infrared sensitizing dyes represented by formulae (IIIa) and (IIIb) are illustrated below. However, the present invention should not be construed as being limited to these infrared sensitizing dyes.

(IIIa-1)

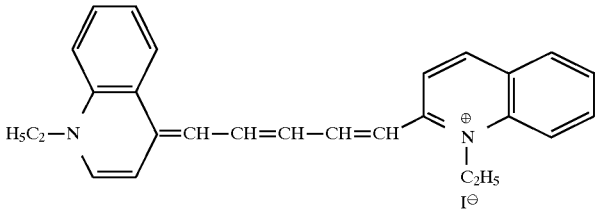

(IIIa-2)

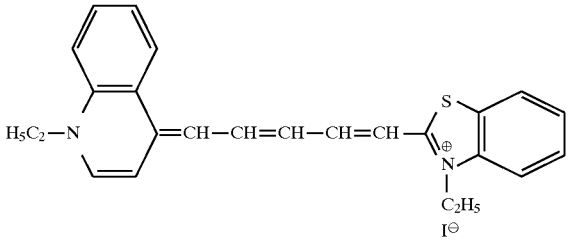

-continued
(IIIa-3)
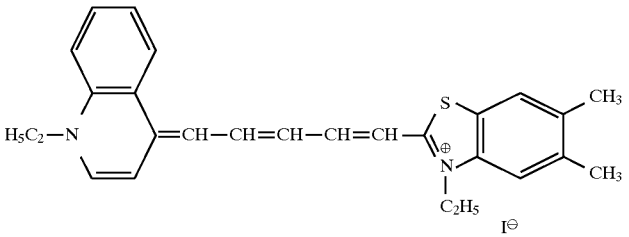
(IIIa-4)
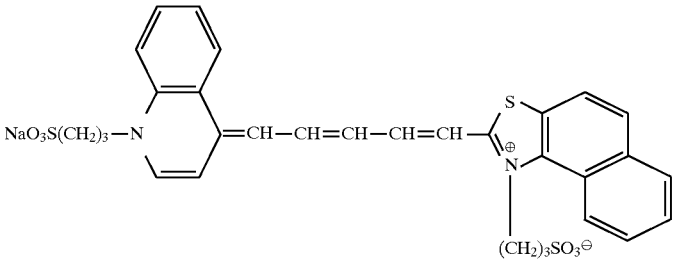
(IIIa-5)
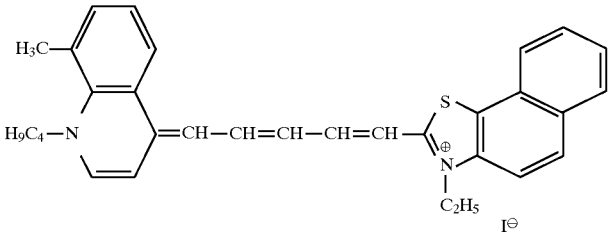
(IIIa-6)
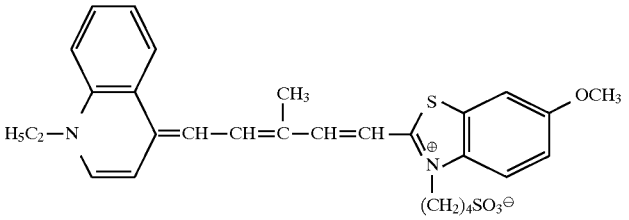
(IIIa-7)
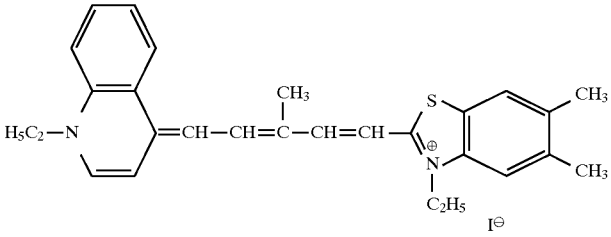
(IIIa-8)
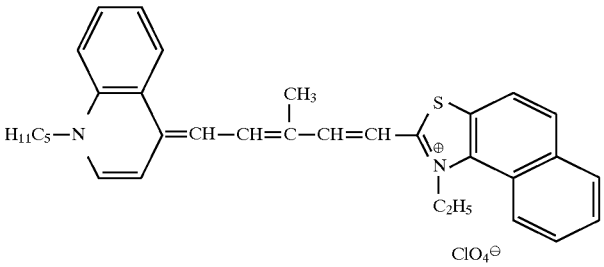

-continued
(IIIa-9)
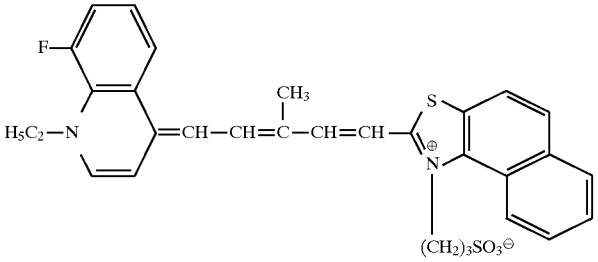
(IIIa-10)
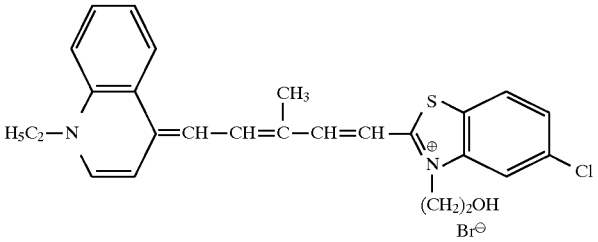
(IIIa-11)
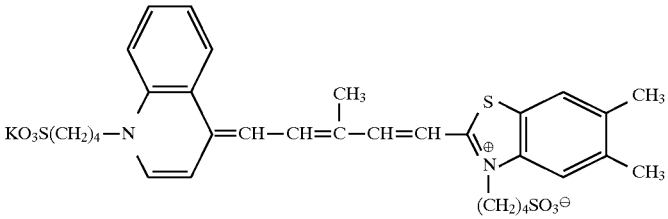
(IIIa-12)
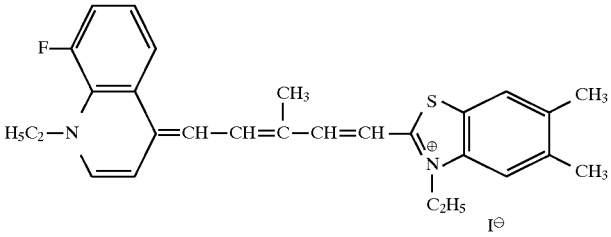
(IIIa-13)
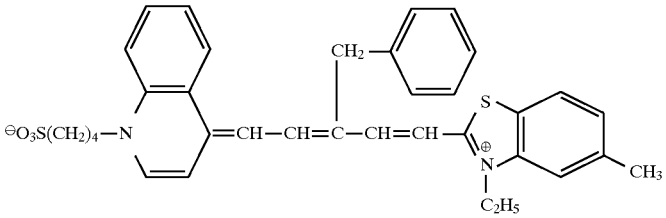
(IIIa-14)
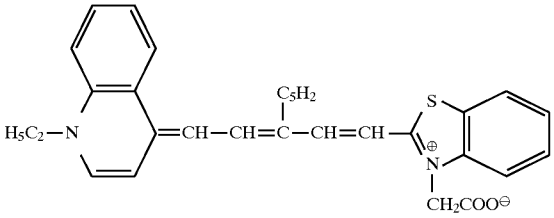
(IIIa-15)
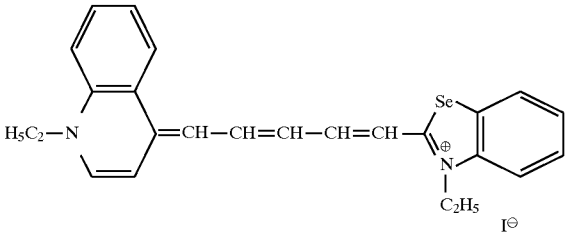

-continued
(IIIa-16)
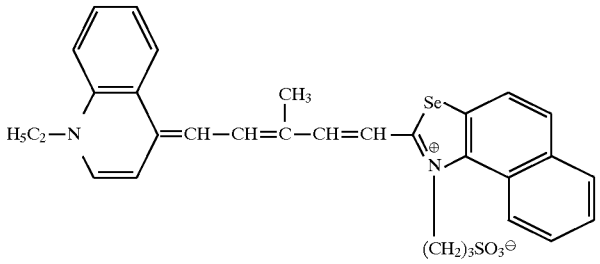
(IIIa-17)
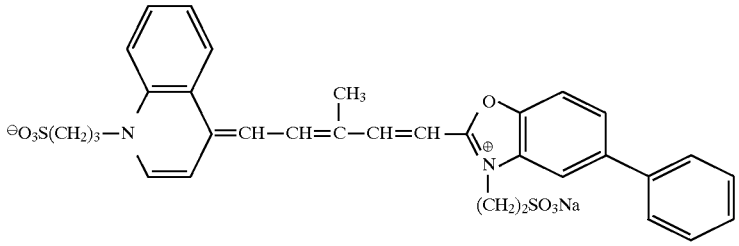
(IIIa-18)
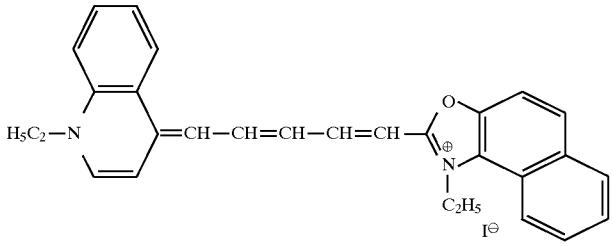
(IIIa-19)
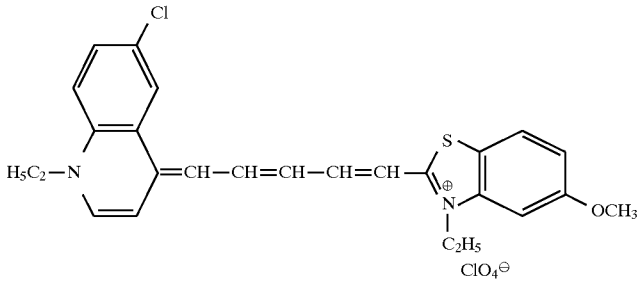
(IIIa-20)
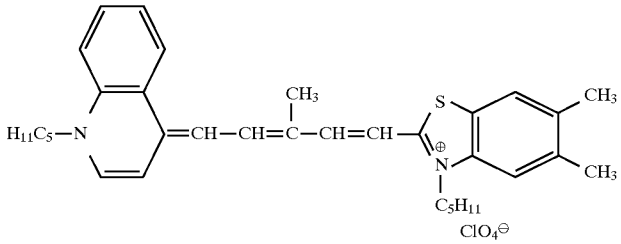
(IIIb-1)
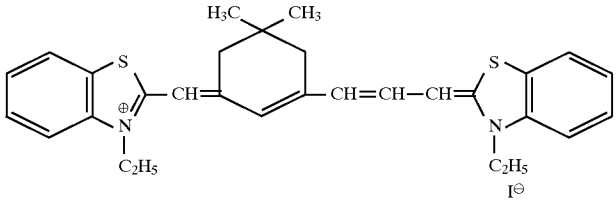

-continued
(IIIb-2)
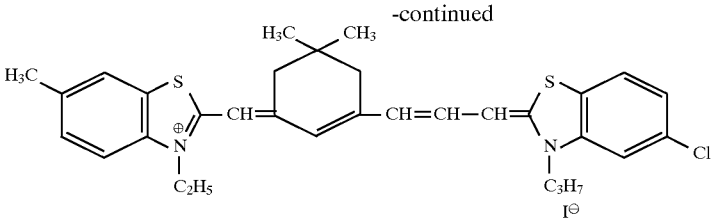
(IIIb-3)
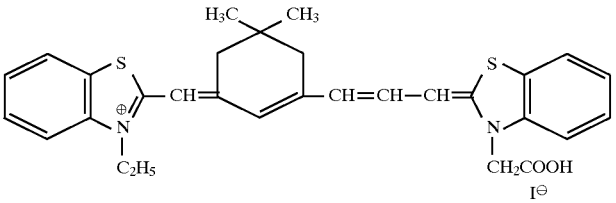
(IIIb-4)
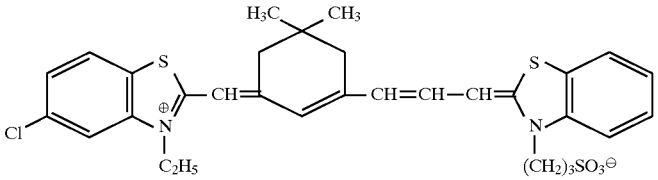
(IIIb-5)
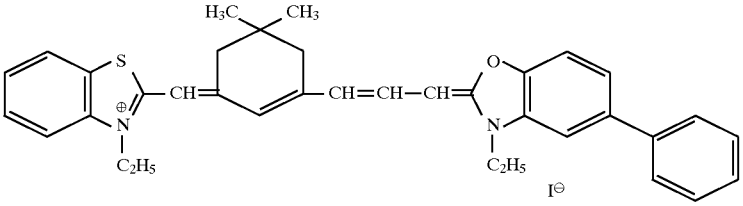
(IIIb-6)
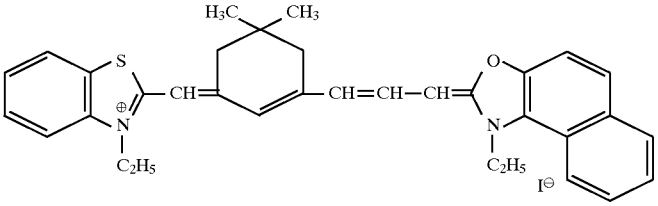
(IIIb-7)
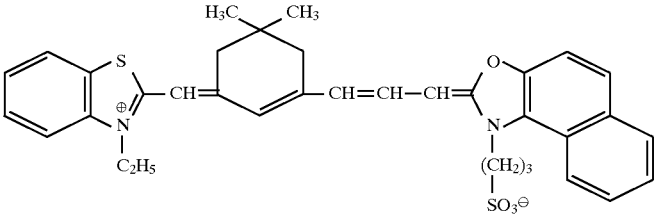
(IIIb-8)
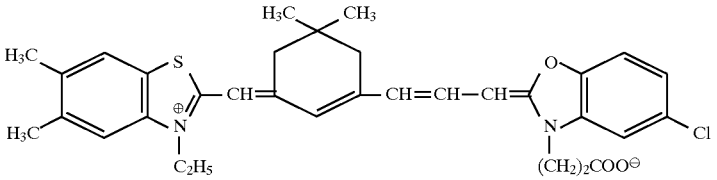
(IIIb-9)
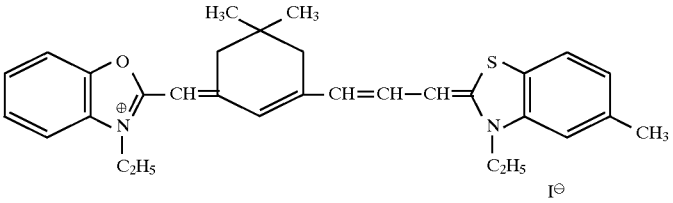

-continued
(IIIb-10)
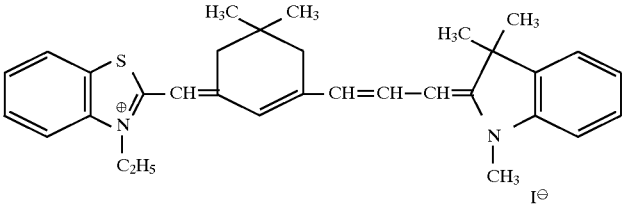
(IIIb-11)
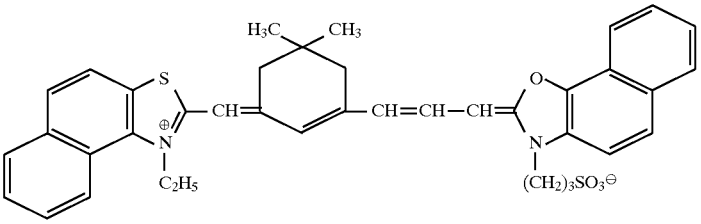
(IIIb-12)
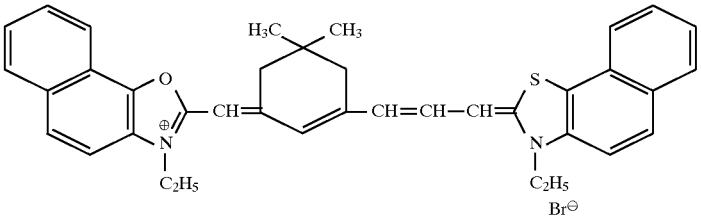
(IIIb-13)
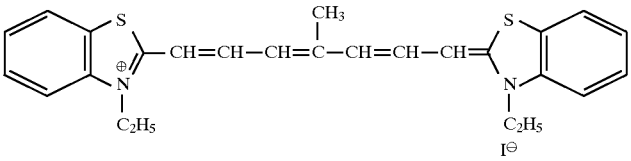
(IIIb-14)
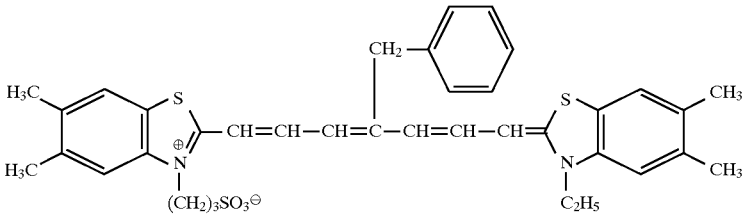
(IIIb-15)
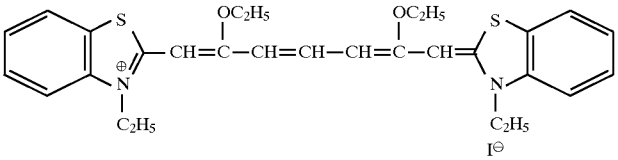
(IIIb-16)
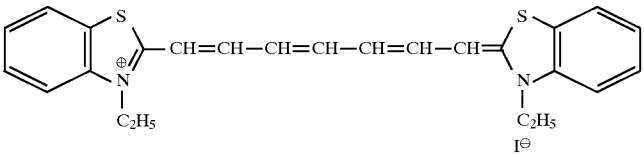
(IIIb-17)
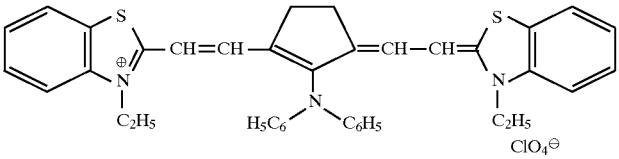

-continued

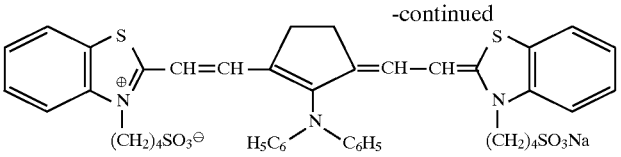

(IIIb-18)

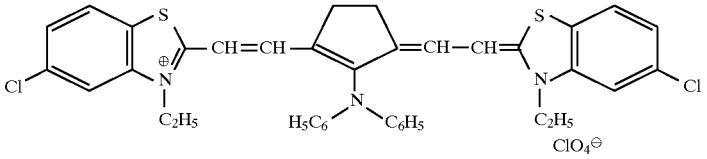

(IIIb-19)

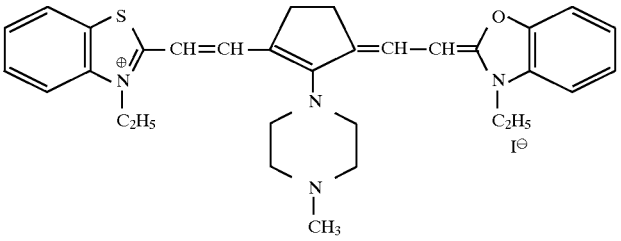

(IIIb-20)

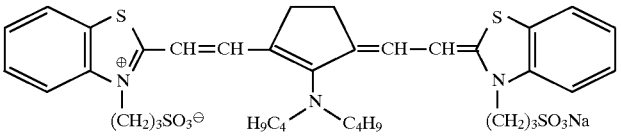

(IIIb-21)

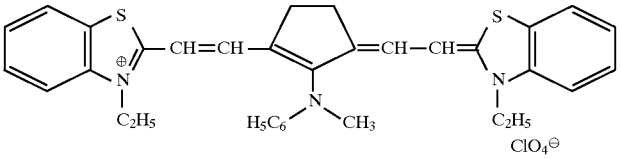

(IIIb-22)

The infrared sensitizing dyes represented by formula (IIIa) can be synthesized according to the method described in JP-A-59-192242, and those represented by formula (IIIb) can be synthesized using, e.g., the methods described in U.S. Pat. Nos. 3,482,978 and 2,756,227.

The infrared sensitizing dye represented by formula (IIIA) or (IIIb) of the present invention is used in an amount of preferably from 0.03 mg to 5 g and more preferably from 0.2 mg to 2.5 g, per mol of silver halide in the emulsion.

The sensitizing dyes represented by formula (IIIa) are preferred in particular because of their excellent sensitization characteristics in the infrared region.

In the photographic material of the present invention, a compound represented by formula (IV) can be used in combination with the above-described sensitizing dyes:

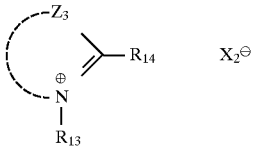

(IV)

wherein $Z_3$ represents a nonmetal atoms necessary to complete a 5- or 6-membered nitrogen-containing hetero ring, with specific examples including thiazoliums (e.g., thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium), oxazoliums (e.g., oxazolium, 4-methyloxazolium, benzoxazolium, 5-chlorobenzoxazolium, 5-phenylbenzoxazolium, 5-methylbenzoxazolium, naphtho[1,2-d]oxazolium), imidazoliums (e.g., 1-methylbenzimidazolium, 1-propyl-5-chlorobenzimidazolium, 1-ethyl-5,6-dichlorobenzimidazolium, 1-allyl-5-trichloromethyl-6-chlorobenzimidazolium), selenazoliums (e.g., benzoselenazolium, 5-chlorobenzoselenazolium, 5-methylbenzoselenazolium, 5-methoxybenzoselenazolium, naphtho[1,2-d]selenazolium), and so on; $R_{13}$ represents a hydrogen atom, an alkyl group containing not more than 8 carbon atoms (e.g., methyl, ethyl, propyl, butyl, pentyl), or an alkenyl group (e.g., allyl); $R_{14}$ represents a hydrogen atom or a lower alkyl group (e.g., methyl, ethyl); and $X_2$ represents an acid anion (e.g., $Cl^-$, $Br^-$, $I^-$, $ClO_4^-$, p-toluenesulfonic acid anion). Among the hetero ring described above as $Z_3$, thiazoliums are used advantageously. In particular, substituted or unsubstituted benzothiazoliums and naphthothiazoliums are preferred.

Specific examples of a compound represented by formula (IV) are illustrated below. However, the present invention should not be construed as being limited to these examples.

(IV-1)

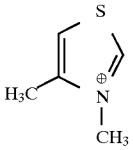

$Br^{\ominus}$ (IV-2)

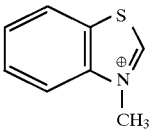

$Br^{\ominus}$ (IV-3)

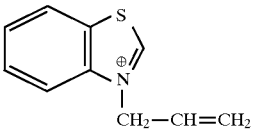

$Br^{\ominus}$ (IV-4)

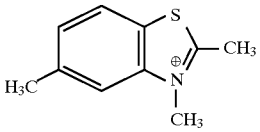

$Cl^{\ominus}$ (IV-5)

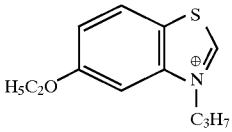

$I^{\ominus}$ (IV-6)

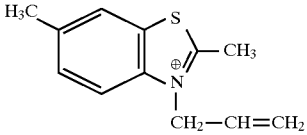

$Br^{\ominus}$ (IV-7)

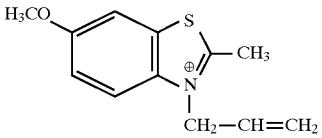

$Br^{\ominus}$ (IV-8)

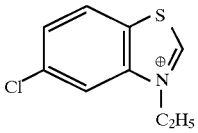

$Br^{\ominus}$ (IV-9)

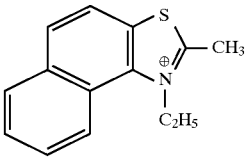

$Br^{\ominus}$ (IV-10)

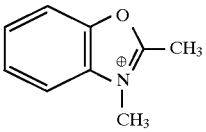

$Br^{\ominus}$ (IV-11)

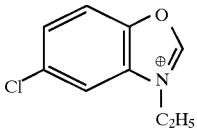

$Br^{\ominus}$

-continued (IV-12)

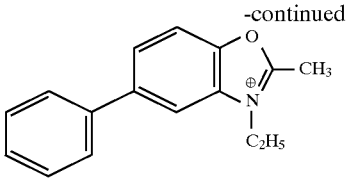

$Br^{\ominus}$ (IV-13)

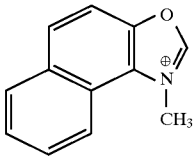

$Br^{\ominus}$ (IV-14)

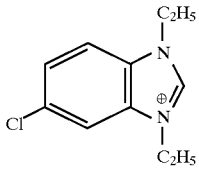

$Br^{\ominus}$ (IV-15)

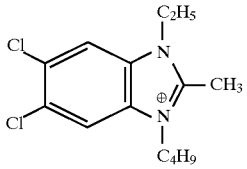

$I^{\ominus}$ (IV-16)

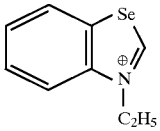

$I^{\ominus}$ (IV-17)

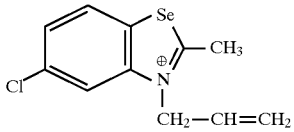

$I^{\ominus}$ (IV-18)

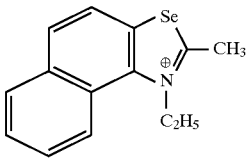

$Br^{\ominus}$

The foregoing compounds represented by formula (IV) are used preferably in an amount of from about 0.01 g to 5 g and more preferably from 0.05 to 3 g, per mol of silver halide in the emulsion.

The ratio of the above-described infrared sensitizing dyes to the compound represented by formula (IV) is preferably from 1/1 to 1/300, particularly preferably from 1/2 to 1/50, by weight.

The compounds of formula (IV) which can be used in the present invention can be dispersed directly into an emulsion or added to an emulsion in the form of a solution prepared by dissolving them into a proper solvent (e.g., water, methyl alcohol, ethyl alcohol, propanol, methyl cellosolve, acetone) or a mixture of two or more of these solvents. Also, they can be added to an emulsion in the form of a dispersion in a solution or colloid according to the addition method for sensitizing dyes.

The compounds represented by formula (IV) may be added to an emulsion before or after the addition of infrared sensitizing dyes. The compounds of formula (IV) and the infrared sensitizing dyes may be dissolved separately and added to an emulsion at the same time independently or after mixing them.

To the combination of the present invention, a compound represented by formula (V) can further be added:

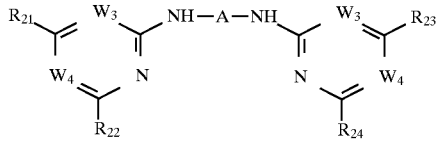

(V)

wherein A represents a divalent aromatic residue; $R_{21}$, $R_{22}$, $R_{23}$ and $R_{24}$ each represents a hydrogen atom, a hydroxy group, an alkyl group, an alkoxy group, an aryloxy group, a halogen atom, a heterocyclic group, a heterocyclic thio group, an arylthio group, an amino group, a substituted or unsubstituted alkylamino group, a substituted or unsubstituted arylamino group, a substituted or unsubstituted aralkylamino group, an aryl group, or a mercapto group, provided that at least one of $R_{21}$, $R_{22}$, $R_{23}$ and $R_{24}$ contains a sulfo group; and $W_3$ and $W_4$ each represents —CH═ or —N═, provided that at least one of $W_3$ and $W_4$ represents —N═.

The formula (V) is illustrated in detail below.

—A— in formula (V) represents a divalent aromatic residue, which may contain —$SO_3M$ (wherein M represents a hydrogen atom, or such a cation as to impart a water solubility (e.g., sodium, potassium)).

Examples of —A— which can be used advantageously include those in the following class —$A_1$— and those included in the following class —$A_2$—. When neither of $R_{21}$, $R_{22}$, $R_{23}$, or $R_{24}$ contains —$SO_3M$, —A— must be selected from the class —$A_1$—.

—$A_1$—:

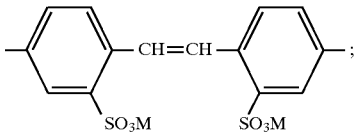

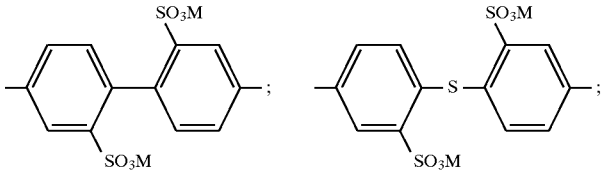

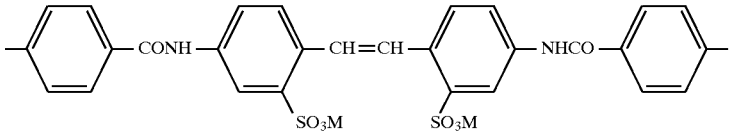

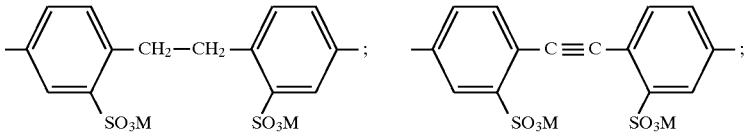

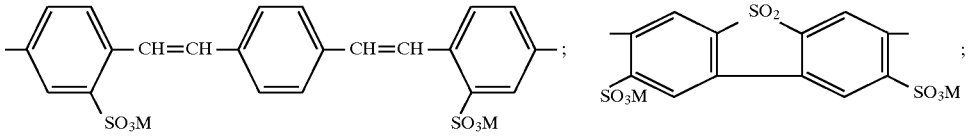

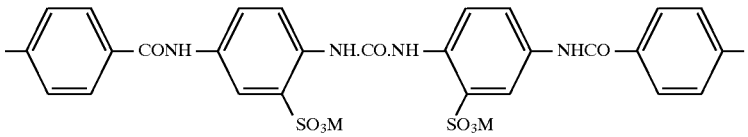

and so on. Therein, M represents a hydrogen atom or a cation capable of imparting a water solubility.

—$A_2$—:

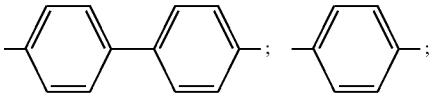

-continued

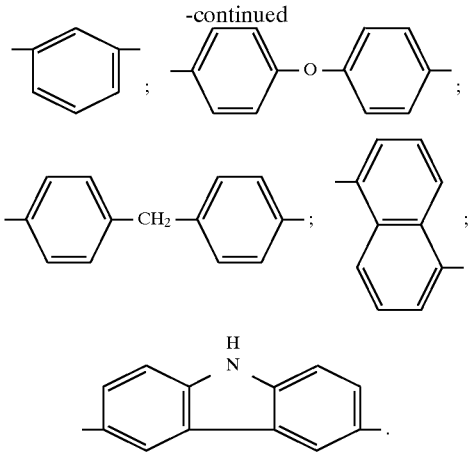

$R_{21}$, $R_{22}$, $R_{23}$ and $R_{24}$ each represents a hydrogen atom, a hydroxy group, a lower alkyl group (preferably containing 1 to 8 carbon atoms, e.g., methyl, ethyl, n-propyl, n-butyl), an alkoxy group (preferably containing 1 to 8 carbon atoms, e.g., methoxy, ethoxy, propoxy, butoxy), an aryloxy group (e.g., phenoxy, naphthoxy, o-tolyloxy, p-sulfophenoxy), a halogen atom (e.g., chlorine, bromine), a heterocyclic group (e.g., morpholinyl, piperidyl), an alkylthio group (e.g., methylthio, ethylthio), a heterocyclic thio group (e.g., benzothiazolylthio, benzimidazolylthio, phenyltetrazolylthio), an arylthio group (e.g., phenylthio, tolylthio), an amino group, an unsubstituted or substituted alkylamino group (e.g., methylamino, ethylamino, propylamino, dimethylamino, diethylamino, dodecylamino, cyclohexylamino, β-hydroxyethylamino, di(β-hydroxyethyl)amino, β-sulfoethylamino), an unsubstituted or substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclic amino group (e.g., 2-benzothiazolylamino, 2-pyridylamino), a substituted or unsubstituted aralkylamino group (e.g., benzylamino, o-anisylamino, m-anisylamino, p-anisylamino), an aryl group (e.g., phenyl), or a mercapto group. $R_{21}$, $R_{22}$, $R_{23}$ and $R_{24}$ may be the same or different. When —A— is selected from the class —$A_2$—, it is necessary for at least one among $R_{21}$, $R_{22}$, $R_{23}$ and $R_{24}$ to contain at least one sulfo group (which may be the form of a free acid or salt). $W_3$ and $W_4$ each represents —CH═ or —N═, provided that at least one of them is —N═.

Specific examples of compounds included in those of formula (V) are given below. However, the present invention should not be construed as being limited to these compounds.

(V-1) Disodium 4,4'-bis[4,6-di(benzothiazolyl-2-thio) pyrimidine-2-ylamino]stilbene-2,2'-disulfonate (V-2) Disodium 4,4'-bis[4,6-di(benzothiazolyl-2-amino) pyrimidine-2-ylamino]stilbene-2,2'-disulfonate (V-3) Disodium 4,4'-bis[4,6-di(naphthyl-2-oxy)pyrimidine-2-ylamino]stilbene-2,2'-disulfonate (V-4) Disodium 4,4'-bis[4,6-di(naphthyl-2-oxy)pyrimidine-2-ylamino]bibenzyl-2,2'-disulfonate (V- 5) Disodium 4,4'-bis(4,6-dianilinopyrimidine-2-ylamino)stilbene-2,2'-disulfonate (V-6) Disodium 4,4'-bis[4-chloro-6-(2-naphthyloxy) pyrimidine-2-ylamino]biphenyl-2,2'-disulfonate (V-7) Disodium 4,4'-bis[4,6-di(1-phenyltetrazolyl-5-thio) pyrimidine-2-ylamino]stilbene-2,2'-disulfonate (V-8) Disodium 4,4'-bis[4,6-di(benzimidazolyl-2-thio) pyrimidine-2-ylamino]stilbene-2,2'-disulfonate (V-9) Disodium 4,4'-bis(4,6-diphenoxypyrimidine-2-ylamino)stilbene-2,2'-disulfonate (V-10) Disodium 4,4'-bis(4,6-diphenylthiopyrimidine-2-ylamino)stilbene-2,2'-disulfonate (V-11) Disodium 4,4'-bis(4,6-dimercaptopyrimidine-2-ylamino)biphenyl-2,2'-disulfonate (V-12) Disodium 4,4'-bis(4,6-dianilinotriazine-2-ylamino) stilbene-2,2'-disulfonate (V-13) Disodium 4,4'-bis(4-anilino-6-hydroxytriazine-2-ylamino)stilbene-2,2'-disulfonate (V-14) Disodium 4,4'-bis(4-naphthylamino-6-anilinotriazine-2-ylamino)stilbene-2,2'-disulfonate (V-15) 4,4'-Bis[2,6-di(2-naphthoxy)pyrimidine-4-ylamino] stilbene-2,2'-disulfonic acid (V-16) Disodium 4,4'-bis[2,6-di(2-naphthylamino) pyrimidine-4-ylamino]stilbene-2,2-disulfonate (V-17) Disodium 4,4'-bis(2,6-dianilinopyrimidine-4-ylamino)stilbene-2,2'-disulfonate (V-18) 4,4'-Bis(2-naphthylamino-6-anilinopyrimidine-4-ylamino)stilbene-2,2'-disulfonic acid (V-19) Ditriethylammonium 4,4'-bis(2,6-diphenoxypyrimidine-4-ylamino)stilbene-2,2'-disulfonate (V-20) Disodium 4,4'-bis[2,6-di(benzimidazolyl-2-thio) pyrimidine-4-ylamino]stilbene-2,2'-disulfonate Compounds represented by formula (V) are known ones, or can be prepared with ease according to known methods.

The compounds of formula (V) may be used as a mixture of two or more thereof. They are used preferably in an amount of from about 0.01 g to 5 g and more preferably from 0.05 to 3 g, per mol of silver halide in the emulsion.

The ratio of the infrared sensitizing dyes to the compounds of formula (V) is preferably from 1/1 to 1/200, particularly preferably from 1/2 to 1/50, by weight.

The compounds of formula (V) which can be used in the present invention can be dispersed directly into an emulsion or added to an emulsion in the form of a solution prepared by dissolving them into a proper solvent (e.g., methyl alcohol, ethyl alcohol, methyl cellosolve, water, or a mixture of two or more thereof). Also, they can be added to an emulsion in the form of a dispersion in a solution or colloid according to addition methods for sensitizing dyes. Moreover, they can be added to and dispersed into an emulsion in accordance with the method disclosed in JP-A-50-80119.

The infrared sensitizing dye represented by formula (IIIa) or (IIIb) can be used in combination with other sensitizing dyes in the present invention. Examples of sensitizing dyes which can be used in combination include those disclosed in U.S. Pat. Nos. 3,703,377, 2,688,545, 3,397,060, 3,615,635 and 3,628,964, British Patents 1,242,588 and 1,293,862, JP-B-43-4936, JP-B-44-14030, JP-B-43-10773, U.S. Pat. No. 3,416,927, JP-B-43-4930, U.S. Pat. Nos. 3,615,613, 3,615,632, 3,617,295 and 3,635,721, and so on.

Useful combination of sensitizing dyes and supersensitizing dyes, and substances having a super-sensitizing effect are described in *Research Disclosure*, Vol. 176, No. 17643, Item IV-J, p. 23 (December, 1978).

For the purpose of preventing the photosensitive material of the present invention from generating fog during the preparation, preservation or photographic processing, or stabilizing photographic properties thereof, the photosensitive material can contain a wide variety of compounds. More specifically, compounds which can be added include a number of known antifoggants or stabilizers, such as azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles and the like; mercaptopyrimidines; mercaptotriazines; thioketo compounds such as oxazolinethione; and azaindenes such as triazaindenes, tetraazaindenes (especially 4-hydroxy substituted (1,3,3a,7) tetraazaindenes), pentaazaindenes or the like.

Addition of polyhydroxybenzene compounds to the photosensitive material is desirable in particular because they can improve pressure resistance without any adverse effect on sensitivity. Polyhydroxybenzene compounds which can be preferably used are those having any of the following structures:

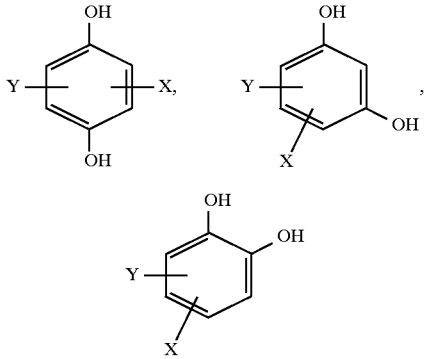

wherein X and Y each represents —H, —OH, a halogen, —OM (where M is an alkali metal ion), an alkyl group, a phenyl group, an amino group, a carbonyl group, a sulfo group, a sulfophenyl group, a sulfoalkyl group, a sulfonamino group, a sulfocarbonyl group, a carboxyphenyl group, a carboxyalkyl group, a carboxyamino group, a hydroxyphenyl group, a hydroxyalkyl group, an alkyl ether group, an alkylphenyl group, an alkyl thioether group, or a phenyl thioether group.

Among these groups, more preferred are —H, —OH, —Cl, —Br, —COOH, $—CH_2CH_2COOH$, $—CH_3$, $—CH_2CH_3$, $—CH(CH_3)_2$, $—C(CH_3)_3$, $—OCH_3$, —CHO, $—SO_3Na$, $—SO_3H$, $—SCH_3$,

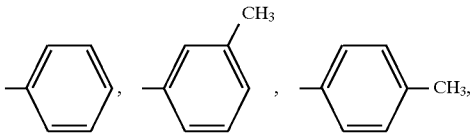

and the like. X and Y may be the same or different.

Typical examples of polyhydroxybenzene compounds which are preferred in particular are illustrated below.

A-(1)

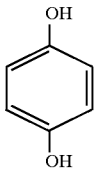

-continued

A-(2)

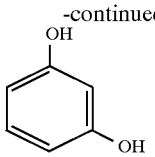

A-(3)

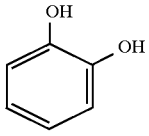

A-(4)

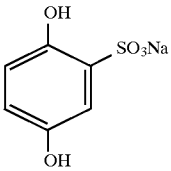

A-(5)

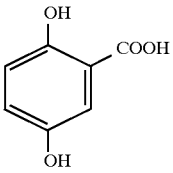

A-(6)

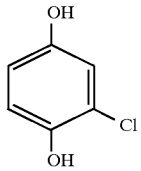

A-(7)

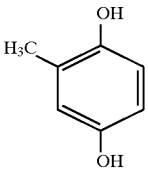

A-(8)

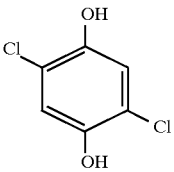

A-(9)

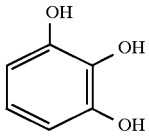

A-(10)

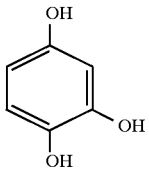

A-(11)

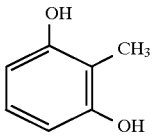

-continued

A-(12)

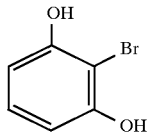

A-(13)

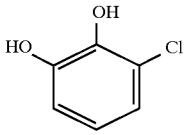

A-(14)

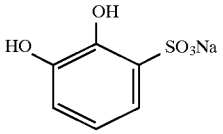

A-(15)

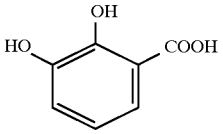

A-(16)

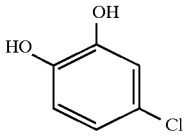

A-(17)

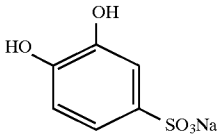

A-(18)

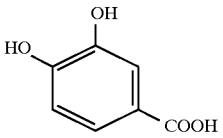

A-(19)

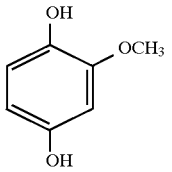

A-(20)

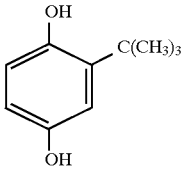

A-(21)

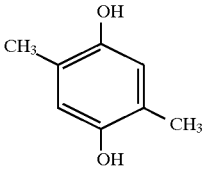

-continued

A-(22)

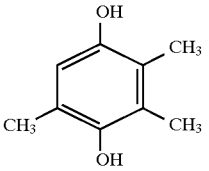

These polyhydroxybenzene compounds may be added to an emulsion layer of the photosensitive material or a layer other than an emulsion layer. It is effective to add them in an amount of from $1\times10^{-5}$ to 1 mol, particularly from $1\times10^{-3}$ to $1\times10^{-1}$ mol, per mol of silver halide.

The photosensitive material prepared in accordance with the present invention may contain water-soluble dyes in a hydrophilic colloid layer as a filter dye or for the prevention of irradiation and other purposes. Examples of dyes useful for these purposes include oxonol dyes, hemioxonol dyes, styryl dyes, merocyanine dyes, cyanine dyes and azo dyes. Among them, oxonol dyes and hemioxonol dyes can be used more advantageously.

For the purpose of increasing sensitivity, increasing contrast, or accelerating development, photographic emulsion layers of the photosensitive material prepared in accordance with the present invention may contain polyalkylene oxides or derivatives thereof, such as their ethers, esters, amines, etc., thioether compounds, thiomorpholines, quaternary ammonium salt compounds, urethane derivatives, urea derivatives, imidazole derivatives, and developing agents such as 3-pyrazolidones, aminophenols, etc.

Among these compounds, 3-pyrazolidones (e.g., 1-phenyl-3-pyrazolidone, 1-phenyl-4-methyl-4-hydroxymethyl-3-pyrazolidone) are preferred, and they are effectively used at a coverage of usually 5 g/m$^2$ or less, preferably from 0.01 to 0.2 g/m$^2$.

Photographic emulsions and light-insensitive hydrophilic colloids in the photographic material of the present invention may contain inorganic or organic hardeners. For example, active vinyl compounds (e.g., 1,3,5-triacryloylhexahydro-s-triazine, bis(vinylsulfonyl)methyl ether, N,N-methylene-bis[β-(vinylsulfonyl)propionamide]), active halogen-containing compounds (e.g., 2,4-dichloro-6-hydroxy-s-triazine), mucohalogenic acids (e.g., mucochloric acid), N-carbamoylpyridinium salts (e.g., (1-morpholinocarbonyl-3-pyridinio)methanesulfonate), and haloamidinium salts (e.g., 1-(1-chloro1-pyridinomethylene) pyrrolidinium, 2-naphthalenesulfonate) can be used alone or in combination of two or more thereof. In particular, the active vinyl compounds disclosed in JP-A-53-41220, JP-A-53-57257, JP-A-59-162546 and JP-A-60-80846, and the active halogen-containing compounds disclosed in U.S. Pat. No. 3,325,287 are effectively used.

In the photographic emulsion layers and other hydrophilic colloid layers of the photosensitive material prepared in accordance with the present invention, various surface active agents may be used for a wide variety of purposes, e.g., as coating aids, as antistatic agents, for improvement of slippability, for emulsification of dispersing aids, for prevention of adhesion, for improvements of photographic characteristics (e.g., acceleration of development, increase of contrast, increase of sensitization), and so on.

Examples of surface active agents suitable for such purposes include nonionic surfactants such as saponin (of the steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicone), glycidol derivatives (e.g., alkenylsuccinic acid polyglycerides, alkylphenol polyglycerides), fatty acid esters of polyhydric alcohols, alkyl esters of sugars, and so on; anionic surfactants containing an acid group, e.g., a carboxy group, a sulfo group, a phospho group, a sulfate group, a phosphate group, etc., such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates and so on; amphoteric surfactants such as amino acids, aminoalkylsulfonic acids, aminoalkylsulfates, aminoalkylphosphates, alkylbetaines, amine oxides, and so on; and cationic surfactants such as alkylamines, aliphatic or aromatic quaternary ammonium salts, heterocyclic quaternary ammonium salts such as pyridinium, imidazolium, etc., aliphatic or heterocyclic phosphonium or sulfonium salts, and so on.

Further, fluorine-containing surfactants as disclosed, e.g., in JP-A-60-80849 are preferably used as antistatic agents.

In order to prevent an adhesion, the photographic material of the present invention can contain a matting agent, such as silica, magnesium oxide, polymethyl methacrylate, etc., in a photographic emulsion layer or another hydrophilic colloid layer.

In the photosensitive material of the present invention, a dispersion of water-insoluble or sparingly water-soluble synthetic polymers can be used for the purpose of improving dimensional stability. Suitable examples of such polymers include those containing as constituent monomers an alkyl (meth)acrylate, an alkoxyacryl (meth)acrylate, a glycidyl (meth)acrylate and so on individually or in combination of two or more thereof, or in combination of one or more of the above-described monomers with acrylic acid, methacrylic acid, and so on.

As the condensing agent or the protective colloid of the photographic emulsions, gelatin is used advantageously. Of course, other hydrophilic colloids can also be used. Specific examples of hydrophilic colloids which can be used include proteins such as gelatin derivatives, graft copolymers prepared from gelatin and other high polymers, albumin, casein, etc.; sugar derivatives such as cellulose derivatives (e.g., hydroxyethyl cellulose, carboxymethyl cellulose, cellulose sulfate), sodium alginate, starch derivatives, etc.; and various kinds of synthetic hydrophilic high molecular substances such as homo- or copolymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole and the like.

Gelatin which can be used include not only lime-processed gelatin, but also acid-processed gelatin, hydrolysis products of gelatin, and enzyme-processed gelatin.

In the silver halide emulsion layers to be used in the present invention, a polymer dispersion of a latex form, such as polyalkyl acrylate latex, can be used.

Examples of a support which can be used for the photosensitive material of the present invention include a cellulose triacetate film, a cellulose diacetate film, a nitrocellulose film, a polystyrene film, a polyethylene terephthalate film, baryta paper, polyolefin-coated paper, and so on.

A developing agent contained in a developer to be used in the present invention does not have any particular restriction. From the standpoint of facility in obtaining desirable halftone dot quality, however, it is desirable to use dihydroxybenzenes as a developing agent. In some cases, combinations of dihydroxybenzenes and 1-phenyl-3-pyrazolidones, or combinations of dihydroxybenzenes and p-aminophenols are employed.

Examples of dihydroxybenzene type developing agents to be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone and the like. Of these hydroquinones, hydroquinone is particularly preferred.

Examples of developing agents of 1-phenyl-3-pyrazolidone or its derivative type which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone and the like.

Examples of p-aminophenol type developing agents which can be used in the present invention include N-methyl-p-aminophenol, p-aminophenol, N-(β-hydroxyethyl)-p-aminophenol, N-(4-hydroxyphenyl) glycine, 2-methyl-p-aminophenol, p-benzylaminophenol, and the like. Among these p-aminophenols, N-methyl-p-aminophenol is preferred.

In general, the developing agent is preferably used in an amount of 0.05 to 0.8 mol/liter. When a combination of a dihydroxybenzene and a 1-phenyl-3-pyrazolidone, or that of a dihydroxybenzene and a p-aminophenol is used, the former agent is preferably used in an amount of 0.05 to 0.5 mol/liter, and the latter is preferably used in an amount of 0.06 mol/liter or less.

Suitable examples of sulfites used as a preservative in the developer of the present invention include sodium sulfite, potassium sulfite, lithium sulfite, ammonium sulfite, sodium bisulfite, potassium metabisulfite, formaldehyde/sodium bisulfite, and so on. A sulfite is preferably used in an amount of 0.3 mol/liter or more, particularly 0.4 mol/liter or more. The upper limit of the amount of a sulfite to be added is preferably 2.5 mol/liter, particularly 1.2 mol/liter.

Suitable examples of alkali agents used for pH adjustment include sodium hydroxide, potassium hydroxide, sodium carbonate, potassium carbonate, sodium tertiary phosphate, potassium tertiary phosphate, sodium silicate, potassium silicate and so on.

Additives which may be used in addition to the above-described constituents include a development inhibitor such as boric acid, borax, sodium bromide, potassium bromide, potassium iodide, etc.; an organic solvent such as ethylene glycol, diethylene glycol, triethylene glycol, dimethylformamide, methyl cellosolve, hexylene glycol, ethanol, methanol, etc.; and an anti-foggant such as mercapto compounds (e.g., 1-phenyl-5-mercaptotetrazole, sodium 2-mercaptobenzimidazole-5-sulfonate), indazole compounds (e.g., 5-nitroindazole, etc.), benzotriazoles (e.g., 5-methylbenzotriazole, etc.), etc. Further, a toning agent, a surface active agent, a defoaming agent, a hard water softener, a hardener and so on may optionally be contained in the developer. In particular, addition of the amino compounds disclosed in JP-A-56-106244 and the imidazole compounds disclosed in JP-B-48-35493 is desirable from the standpoint of accelerating the development or increasing the photographic speed.

In the developer to be used in the present invention, the compounds disclosed in JP-A-56-24347 as a silver stain inhibitor, the compounds disclosed in JP-A-62-212651 as an uneven development inhibitor, and the compounds disclosed in JP-A-61-267759 can be used.

In the developer to be used in the present invention, buffering agents, such as boric acid disclosed in JP-A-62-186259, sugars (e.g., saccharose) disclosed in JP-A-60-93433, oximes (e.g., acetoxime), phenols (e.g., 5-sulfosalicylic acid), tertiary phosphates (e.g., sodium phosphates, potassium phosphates), and so on may be used. Among them, boric acid is used advantageously.

A fixer is an aqueous solution containing a fixing agent, and optionally a hardener (e.g., water-soluble aluminum compounds), acetic acid and a dibasic acid (e.g., tartaric acid, citric acid, or a salt thereof), and having a pH value of 3.8 or more, preferably from 4.0 to 4.5.

As examples of a fixing agent, sodium thiosulfate, ammonium thiosulfate and so on can be referred to. From the standpoint of fixing speed, ammonium thiosulfate is particularly preferred. The amount of the fixing agent generally is from about 0.1 mol/liter to about 5 mol/liter, though it can be changed properly depending on the circumstances.

A water-soluble aluminum salt to function mainly as a hardener in the fixer is a compound known generally as a hardener for an acid-hardenable fixer, with specific examples including aluminum chloride, aluminum sulfate, potassium alum and so on.

As the above-described dibasic acid, tartaric acid, citric acid, and derivatives thereof can be used alone or in combination with two or more thereof. These compounds are effective when used in an amount of 0.005 mol or more, particularly 0.01 to 0.03 mol, per liter of the fixer.

Specific examples of preferred dibasic acids include tartaric acid, potassium tartarate, sodium tartarate, potassium sodium tartarate, ammonium tartarate, ammonium potassium tartarate, and so on.

Examples of citric acid or derivatives thereof which are effective in the present invention include citric acid, sodium citrate, potassium citrate, and so on.

The fixer may optionally contain preservatives (e.g., sulfites, bisulfites), pH buffering agents (e.g., acetic acid, boric acid), pH adjusting agents (e.g., ammonia, sulfuric acid), agents for improving on the keeping quality of image (e.g., potassium iodide), and chelating agents. Herein, the pH buffering agents are used in an amount of generally from 10 to 40 g/liter, preferably from 18 to 25 g/liter, because of the high pH of the developer used.

A temperature and a time suitable for fixation are the same as those for development, and a range from 10 seconds to 1 minute is preferred at temperatures of from about 20° C. to about 50° C.

In the washing water, antimold compounds (e.g., compounds described in Horiguchi, *Bohkin Bohbai no Kagaku* (which means "Chemistry of Antibacteria and Antimold"), compounds disclosed in JP-A-62-115154), washing accelerators (e.g., sulfite), chelating agents, and so on may be used.

According to the above-described method, the photographic material which has been developed and fixed is washed and dried. Washing is carried out in order to remove almost completely silver salts dissolved by fixation. Preferably, it takes from 10 seconds to 3 minutes at about 20° C. to about 50° C. to effect the washing. Drying is carried out at about 40° C. to about 100° C., and the drying time can be changed properly depending on the condition of the surroundings. In general, it may range from about 5 seconds to 3 minutes and 30 seconds.

A roller carrier type automatic developing machine is described, e.g., in U.S. Pat. Nos. 3,025,779 and 3,545,971, and so on, and referred to simply as a roller carrier type processor in this specification. The roller carrier type processor is composed of four units, that is, developing, fixing, washing and drying units. In the processing of the present invention, though other processes (e.g., the stop process) are not excluded, it is most desirable that these four processes should be followed. Herein, water can be saved by applying a two- or three-stage countercurrent washing method to the washing process.

It is desirable for preservation that the developer to be used in the present invention should be wrapped with a material which has a low oxygen permeation rate, as described in JP-A-61-73147. To the developer which can be used in the present invention, the replenishing system described in JP-A-62-91939 can be applied.

When subjected to reduction processing, the silver halide photographic material of the present invention can retain high density notwithstanding a decrease in dot area, because it has the ability to provide a high Dmax.

The present invention is not particularly restricted as to the reducing solution to be used. Reducing solutions which can be used are, for example, those described in books written by, e.g., C. E. K. Mees, *The Theory of the Photographic Process*, pp. 738 to 744, Macmillan, New York (1954), *Tetsuo Yano, Shashin Shori, Sono Riron to Jissai* (which means "Photographic Processing, Its Theory and Practice"), pp. 166 to 169, Kyoritsu Shuppan, Tokyo (1978), etc., and JP-A-50-27543, JP-A-52-68429, JP-A-55-17123, JP-A-55-79444, JP-A-57-10140, JP-A-57-142639, JP-A-61-61156, and so on. More specifically, a reducing solution can contain as an oxidizing agent a permanganate, a persulfate, a ferric salt, a cupric salt, a ceric salt, a potassium ferricyanide, a dichromate and the like individually or in combination, and optionally an inorganic acid such as sulfuric acid, and an alcohol. Also, a reducing solution containing an oxidizing agent such as a potassium ferricyanide, an ethylenediaminetetraacetatoferrate(III) or the like, a silver halide solvent such as a thiosulfate, rhodanide, thiourea or a derivative thereof, or so on, and optionally an inorganic acid like sulfuric acid, and the like can be employed.

Examples of reducing solutions which can be used in the present invention include the so-called Farmer's reducer, an ethylenediaminetetraacetatoferrate(III) reducer, a potassium permanganate reducer, an ammonium persulfate reducer (Kodak R-5), and a ceric salt reducer.

The reduction processing is preferably completed in a time of from several seconds to several decades minutes, particularly in several minutes, at a temperature of generally from 10° C. to 40° C., particularly from 15° C. to 30° C. Within the limits of the foregoing conditions, a sufficiently broad range of reduction can be obtained by using the graphic arts photosensitive material of the present invention.

The reducer is made to act on the silver image formed in an emulsion layer through a light-insensitive upper layer.

The reduction can be carried out in various ways. For example, the graphic arts photosensitive material is soaked in a reducing solution with stirring, or a reducing solution is applied to the surface of the graphic arts photosensitive material using a brush, a roller or the like.

The present invention will now be illustrated in more detail by reference to the following examples. However, the present invention should not be construed as being limited to this example. It should be noted that unless stated otherwise, all parts, percents, and ratios are by weight.

EXAMPLE

Preparation of Emulsions

Emulsion A

A water solution containing 0.13 mol of silver nitrate and a water solution containing 0.04 mol of potassium bromide and 0.09 mol of sodium chloride were added over a 12 minute period at 45° C. to an aqueous gelatin solution containing sodium chloride and 1,8-dihydroxy-3,6-dithiaoctane with stirring in accordance with the double jet method to obtain silver chlorobromide grains having an average grain size of 0.15 μm and a chloride content of 70 mol %, thus achieving nucleation. Thereto were further added a water solution containing 0.87 mol of silver nitrate and a water solution containing 0.26 mol of potassium bromide and 0.65 mol of sodium chloride over a 20 minute period using the double jet method. Thereafter, the thus obtained emulsion was washed in a conventional manner through flocculation, and then 40 g of gelatin was added thereto. Further, it was adjusted to pH 6.5 and pAg 7.5, and then chemically sensitized by adding thereto sodium thiosulfate and chloroauric acid in amounts of 5 mg and 8 mg, respectively, per mol of silver and heating the resulting emulsion at 60° C. for 75 minutes. Furthermore, 150 mg of 1,3,3a,7-tetraazaindene was added as a stabilizer. The thus prepared emulsion grains were silver chlorobromide cubic grains having an average grain size of 0.28 μm and a chloride content of 70 mol %. (Variation coefficient: 10%)

Emulsion B

Silver chlorobromide cubic grains having an average grain size of 0.28 μm and a chloride content of 70 mol % (variation coefficient: 10%) were prepared in the same manner as in Emulsion A, except that 10 mg of Compound (I-1) included in compounds represented by formula (I-a) was further added to the aqueous gelatin solution containing sodium chloride and 1,8-dihydroxy-3,6-dithiaoctane.

Emulsion C

After nucleation, washing and dispersion were carried out in the same manner as in preparation of Emulsion A, Compound (I-1) included in compounds represented by formula (I-a) was added in an amount of 20 mg per mol of silver, and then chemical sensitization was carried out in the same manner as in Emulsion A, thus producing silver chlorobromide cubic grains having an average grain size of 0.28 μm and a chloride content of 70 mol %. (Variation coefficient: 10%)

Emulsion D

Silver chlorobromide cubic grains containing $1.0\times10^{-7}$ mol of Rh and $6.0\times10^{-7}$ mol of Ir, per mol of silver and having an average grain size of 0.28 μm and a chloride content of 70 mol % (variation coefficient: 10%) were obtained in the same manner as in preparation of Emulsion A, except that ammonium hexachlororhodanate(III) was further added to the aqueous halide solution used in the nucleation step, and potassium hexachloroiridate(III) was further added to the aqueous halide solution containing 0.26 mol of potassium bromide and 0.65 mol of sodium chloride.

Emulsion E

Silver chlorobromide cubic grains containing $1.0\times10^{-7}$ mol of Rh and $6.0\times10^{-7}$ mol of Ir, per mol of silver and having an average grain size of 0.28 μm and a chloride content of 70 mol % (variation coefficient) were obtained in the same manner as in preparation of Emulsion B, except that ammonium hexachlororhodanate(III) was further added to the aqueous halide solution used in the nucleation step, and potassium hexachloroiridate(III) was further added to the aqueous halide solution containing 0.26 mol of potassium bromide and 0.65 mol of sodium chloride.

Emulsion F

Silver chlorobromide cubic grains containing $1.0\times10^{-7}$ mol of Rh and $6.0\times10^{-7}$ mol of Ir, per mol of silver and having an average grain size of 0.28 μm and a chloride content of 70 mol % (variation coefficient: 10%) were obtained in the same manner as in preparation of Emulsion C, except that ammonium hexachlororhodanate(III) was further added to the aqueous halide solution used in the nucleation step, and potassium hexachloroiridate(III) was further added to the aqueous halide solution containing 0.26 mol of potassium bromide and 0.65 mol of sodium chloride.

Preparation of Coating Samples

To 1 kg of each of the foregoing emulsions was added 60 ml of a 0.05 wt % solution of the infrared sensitizing dye illustrated by (IIIb-6) to effect the sensitization in the infrared region. To this emulsion were further added 70 ml of a 0.5 wt % methanol solution of disodium 4,4'-bis(4,6-dinaphthoxypyrimidine-2-ylamino)stilbenedisulfonate and 90 ml of a 0.5 wt % methanol solution of 2,5-dimethyl-3-allylbenzothiazole iodide for the purpose of supersensitization and stabilization.

To the resulting emulsion were further added 100 mg/m$^2$ of hydroquinone, polyethyl acrylate latex as a plasticizer in a proportion of 25 wt % to the gelatin binder, and 86.2 mg/m$^2$ of 2-bis(vinylsulfonylacetamido)ethane as a hardener. The thus prepared emulsion was coated on a polyester support so as to have a silver coverage of 3.7 g/m$^2$. Therein, the gelatin coverage was 2.5 g/m$^2$.

On this coat, an upper protective layer containing 0.6 g/m$^2$ of gelatin, a matting agent composed of 60 mg/m$^2$ of polymethyl methacrylate particles having a particle size of 3 to 4 μm, 70 mg/m$^2$ of colloidal silica and 10 mg/m$^2$ of silicone oil, and a coating aid composed of sodium dodecylbenzenesulfonate and the fluorine-containing surfactant of the following structural formula (1), and a lower protective layer containing 0.7 g/m$^2$ of gelatin, 225 mg/m$^2$ of polyethyl acrylate latex, 20 mg/m$^2$ of the dye of the following structural formula (2), 10 mg/m$^2$ of the dye of the following structural formula (3), and sodium dodecylbenzenesulfonate as a coating aid were coated simultaneously. Thus, the samples were prepared.

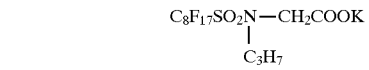

(1)

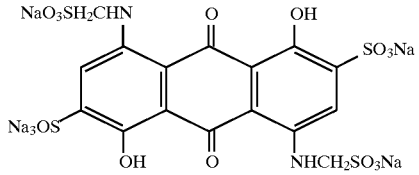

(2)

(3)

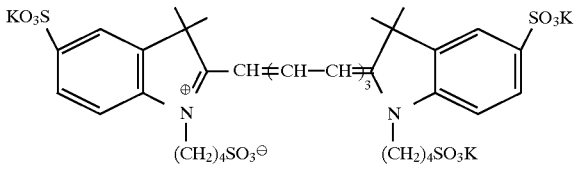

The support used herein had a backing layer and a back protecting layer with the following compositions.

(The swelling degree of the backing layer was 110%.)

| Composition of the Backing Layer: | |
|---|---|
| Gelatin | 3.0 g/m$^2$ |
| Sodium Dodecylbenzenesulfonate | 80 mg |
| Dye (a) | 80 mg |
| Dye (b) | 30 mg |
| Dye (c) | 100 mg |
| 1,3-Divinylsulfonyl-2-propanol | 60 mg/m$^2$ |
| Potassium Polyvinylbenzenesulfonate | 30 g/m$^2$ |

Dye (a)

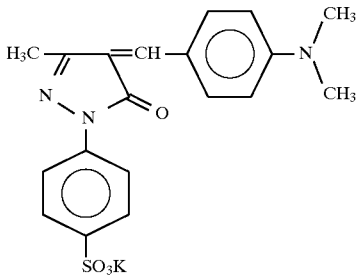

Dye (b)

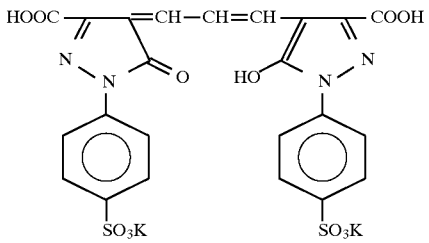

Dye (c)

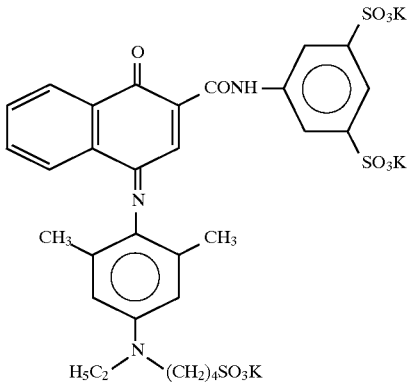

| Composition of the Back Protecting Layer: | |
|---|---|
| Gelatin | 0.75 g/m$^2$ |
| Polymethyl Methacrylate (particle size: 4.7 $\mu$m) | 30 mg/m$^2$ |
| Sodium Dodecylbenzenesulfonate | 20 mg/m$^2$ |
| Fluorine-Containing Surfactant (the foregoing Compound (1)) | 2 mg/m$^2$ |
| Silicone Oil | 100 mg/m$^2$ |

Evaluation of Photographic Properties

Each of the obtained samples was exposed to a xenon flash lamp with a light emission time of $1\times10^{-6}$ sec through an interference filter having a peak transmission at 780 nm and a continuous wedge, and subjected to photographic processing including 38° C., 20 sec developing, fixing, washing and drying processes using an automatic developing machine, FG-360F (washing tank volume: 6 liters) made by Fuji Photo Film Co., Ltd., wherein the developer and the fixer having the following compositions were used, thus achieving sensitometry.

A reciprocal of the exposure required for obtaining the density 3.0 was defined as sensitivity, and the sensitivities of the samples prepared are shown in Table 1 as relative values.

A slope of the straight line connecting the point of density 0.1 to the point of density 3.0 on the characteristic curve was defined as gradation, and the values obtained are also shown in Table 1.

As is apparent from the comparison between Sample No. 1 and Sample No. 2 or No. 3 in Table 1, the contrast (i.e., the gradation) is increased by adding Compound (I-1) but the increase of the contrast is slight.

As is apparent from the comparison between Sample No. 1 and Sample No. 4 in Table 1, the contrast is increased by adding the group VIII metal (i.e., Rh/Ir) as compared with that of Sample Nos. 2 and 3, but the sensitivity is decreased.

However, as is apparent from the comparison between Sample Nos. 5 and 6 according to the present invention and the comparative samples (Sample Nos. 1, 2, 3 and 4), the sensitivity is slightly decreased by adding the group VIII metal but the contrast is extremely increased by Compound (I-1).

Thus, it is clearly seen from the data of Table 1 that the samples (Nos. 5 and 6) prepared in accordance with the present invention provide high contrast without a lowering of sensitivity.

| Formula of the Developer: | |
|---|---|
| Water | 720 ml |
| Disodium Ethylenediaminetetraacetate | 4 g |
| Sodium Hydroxide | 44 g |
| Sodium Sulfite | 45 g |
| 2-Methylimidazole | 2 g |
| Sodium Carbonate | 26.4 g |
| Boric Acid | 1.6 g |
| Potassium Bromide | 1 g |
| Hydroquinone | 36 g |
| Diethylene Glycol | 39 g |
| 5-Methylbenzotriazole | 0.2 g |
| 1-Phenyl-3-pyrazolidone | 0.7 g |
| Water to make | 1,000 ml |
| **Formula of the Fixer:** | |
| Ammonium Thiosulfate | 170 g |
| Sodium Sulfite (anhydrous) | 15 g |
| Boric Acid | 7 g |
| Glacial Acetic Acid | 15 ml |
| Potassium Alum | 20 g |
| Ethylenediaminetetraacetic Acid | 0.1 g |
| Tartaric Acid | 3.5 g |
| Water to make | 1,000 ml |

TABLE 1

| Sample No. | Emulsion | Group VIII Metal Contained | Compound of Formula (I-a) Kind | Amount Added (mg/mol Ag) | Sensitivity | Gradation | Note |
|---|---|---|---|---|---|---|---|
| 1 | A | — | — | — | 100 | 3.35 | Comparison |
| 2 | B | — | (I-1) | 10 | 102 | 4.41 | Comparison |
| 3 | C | — | (I-1) | 20 | 104 | 4.50 | Comparison |
| 4 | D | Rh, Ir | — | — | 83 | 5.73 | Comparison |
| 5 | E | Rh, Ir | (I-1) | 10 | 86 | 6.25 | Invention |
| 6 | F | Rh, Ir | (I-1) | 20 | 85 | 6.39 | Invention |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide photographic emulsion layer of a silver halide emulsion, wherein said emulsion layer comprises monodisperse cubic silver halide grains which contain at least one metal atom of group VIII in the Periodic Table, and said silver halide emulsion is spectrally sensitized so as to have a sensitization maximum at a wavelength of 750 nm or more and further contains at least one of compounds represented by formulae (I-a), (I-b) and (I-c), in an amount of from $1\times10^{-4}$ to $2\times10^{-2}$ g per mol of Ag:

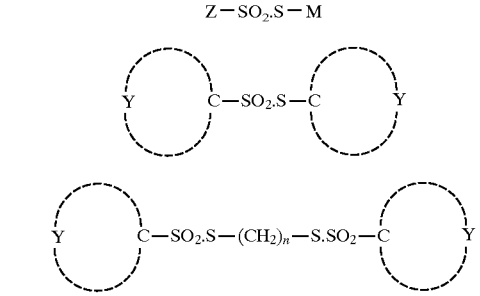

(I-a)

(I-b)

(I-c)

wherein Z represents an alkyl group containing 1 to 18 carbon atoms, an aryl group containing 6 to 18 carbon atoms, or a heterocyclic group; Y represents atoms necessary to complete an aromatic ring containing 6 to 18 carbon atoms, or a heterocyclic ring; M represents a metal atom or an organic cation; and n represents an integer of from 2 to 10, wherein said silver halide emulsion is spectrally sensitized by at least one of the infrared sensitizing dyes represented by (IIIa) and (IIIb):

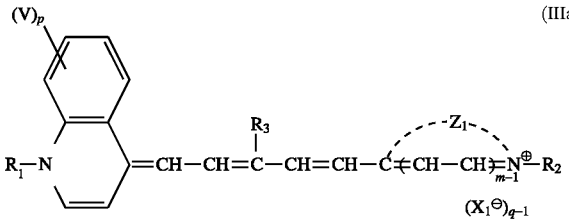

(IIIa)

wherein in formula (IIIa), $R_1$ and $R_2$ may be the same or different, each being an alkyl group; $R_3$ represents a hydrogen atom, lower alkyl group having 1–4 carbon atoms, a lower alkoxy group having 1–4 carbon atoms, a phenyl group, a benzyl group, or a phenethyl group; V represents a hydrogen atom, a lower alkyl group having 1–4 carbon atoms, an alkoxy group, a halogen atom, or a substituted lower alkyl group having 1–4 carbon atoms; $Z_1$ represents nonmetal atoms necessary to complete a 5- or 6-membered nitrogen-containing heterocyclic ring; $X_1$ represents an acid anion; and m, p and q represent 1 or 2, provided that q is 1 when the dye forms an inner salt;

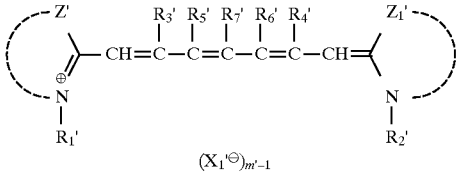

(IIIb)

wherein in formula (IIIb), $R_1'$ and $R_2'$ may be the same or different, and each represents an alkyl group; $R_3'$ and $R_4'$ each represents a hydrogen atom, a lower alkyl group having 1–4 carbon atoms, a lower alkoxy group having 1–4 carbon atoms, a phenyl group, a benzyl group or a phenethyl group; $R_5'$ and $R_6'$ each represents a hydrogen atom, or they may be linked with each other to form a divalent alkylene group; $R_7'$ represents a hydrogen atom, a lower alkyl group having 1–4 carbon atoms, a lower alkoxy group having 1–4 carbon atoms, a phenyl group, a benzyl group or

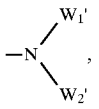

wherein $W_1'$ and $W_2'$ each may represent an alkyl group or an aryl group, or they may be linked with each other to complete a 5- or 6-membered nitrogen-containing heterocyclic ring, or $R_3'$ and $R_7'$ or $R_4'$ and $R_7'$ may be linked to form a divalent alkylene group; Z' and $Z_1'$ represents nonmetal atoms necessary to complete a 5- or 6-membered nitrogen-containing heterocyclic ring; $X_1'$ represents an acid anion and m' represents 1 or 2, provided that m' is 1 when the dye forms an inner salt.

2. The silver halide photographic material as in claim 1, having as said silver halide emulsion an emulsion prepared so that said at least one of compounds represented by formulae (I-a), (I-b) and (I-c) is present during grain formation or chemical ripening.

3. The silver halide photographic material as in claim 1, wherein said at least one of compounds represented by formulae (I-a), (I-b) and (I-c) is present in an amount of $1\times10^{-4}$ to $1\times10^{-2}$ g per mol of Ag.

4. The silver halide photographic material as in claim 1, wherein said metal atom of group VIII is selected from the group consisting of Rh, Ir and Fe.

5. The silver halide photographic material as in claim 1, wherein said silver halide emulsion further contains at least one compound represented by formula (IV):

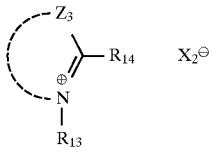

(IV)

wherein $Z_3$ represents nonmetal atoms necessary to complete a 5- or 6-membered nitrogen-containing heterocyclic ring; $R_{13}$ represents a hydrogen atom, an alkyl group containing not more than 8 carbon atoms, or an alkenyl group; $R_{14}$ represents a hydrogen atom or a lower alkyl group having 1–4 carbon atoms; and $X_2$ represents an acid anion.

6. The silver halide photographic material as in claim 1, wherein said silver halide emulsion further contains at least one compound represented by formula (V):

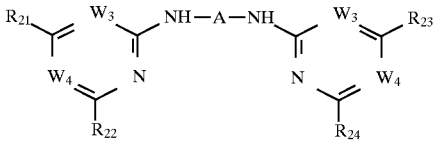

(V)

wherein A represents a divalent aromatic residue; $R_{21}$, $R_{22}$, $R_{23}$ and $R_{24}$ each represents a hydrogen atom, a hydroxy group, an alkyl group, an alkoxy group, an aryloxy group, a halogen atom, a heterocyclic group, a heterocyclic thio group, an arylthio group, an amino group, an aryl group, or a mercapto group, provided that at least one of $R_{21}$, $R_{22}$, $R_{23}$ and $R_{24}$ contains a sulfo group; and $W_3$ and $W_4$ each represents —CH═ or —N═, provided that at least one of $W_3$ and $W_4$ represents —N═, and provided that both $W_3$ groups are the same and both $W_4$ groups are the same.

7. The silver halide photographic material as in claim 1, wherein said silver halide emulsion further contains at least one compound represented by formula (IV) and at least one compound represented by formula (V):

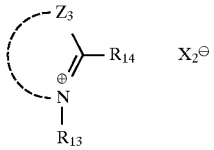

(IV)

wherein $Z_3$ represents nonmetal atoms necessary to complete a 5- or 6-membered nitrogen-containing heterocyclic ring; $R_{13}$ represents a hydrogen atom, an alkyl group containing not more than 8 carbon atoms, or an alkenyl group; $R_{14}$ represents a hydrogen atom or a lower alkyl group having 1 to 4 carbon atoms; and $X_2$ represents an acid anion;

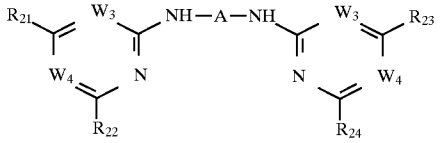

(V)

wherein A represents a divalent aromatic residue; $R_{21}$, $R_{22}$, $R_{23}$ and $R_{24}$ each represents a hydrogen atom, a hydroxy group, an alkyl group, an alkoxy group, an aryloxy group, a halogen atom, a heterocyclic group, a heterocyclic thio group, an arylthio group, an amino group, an aryl group, or a mercapto group, provided that at least one of $R_{21}$, $R_{22}$, $R_{23}$ and $R_{24}$ contains a sulfo group; and $W_3$ and $W_4$ each represents —CH═ or —N═, provided that at least one of $W_3$ and $W_4$ represents —N═, and provided that both $W_3$ groups are the same and both $W_4$ groups are the same.

* * * * *